US007533942B2

(12) United States Patent
Kennedy et al.

(10) Patent No.: US 7,533,942 B2
(45) Date of Patent: May 19, 2009

(54) MINE REFUGE

(75) Inventors: William R. Kennedy, Taylorville, IL (US); John M. Kennedy, Taylorville, IL (US)

(73) Assignee: Kennedy Metal Products & Buildings, Inc., Taylorville, IL (US)

( * ) Notice: Subject to any disclaimer, the term of this patent is extended or adjusted under 35 U.S.C. 154(b) by 99 days.

(21) Appl. No.: 11/625,052

(22) Filed: Jan. 19, 2007

(65) Prior Publication Data

US 2007/0199244 A1 Aug. 30, 2007

Related U.S. Application Data

(60) Provisional application No. 60/777,021, filed on Feb. 27, 2006.

(51) Int. Cl.
*E21F 11/00* (2006.01)

(52) U.S. Cl. ..... 299/12; 299/95

(58) Field of Classification Search ..... 299/10, 299/12, 95

See application file for complete search history.

(56) References Cited

U.S. PATENT DOCUMENTS

| | | | |
|---|---|---|---|
| 4,027,912 | A | 6/1977 | Pacca |
| 4,035,796 | A | 7/1977 | Hedly |
| 4,065,167 | A | 12/1977 | Wright |
| 4,144,801 | A | 3/1979 | Wallace |
| 4,196,656 | A | 4/1980 | Gaudiano |
| 4,294,242 | A | 10/1981 | Cowans |
| 4,581,986 | A | 4/1986 | Conklin |
| 4,667,580 | A | 5/1987 | Wetzel |
| 4,706,551 | A | 11/1987 | Schofield |
| 4,707,953 | A | 11/1987 | Anderson |
| 4,726,155 | A | 2/1988 | Nahmias |
| 4,736,762 | A | 4/1988 | Wayman |
| 4,742,653 | A | 5/1988 | Napier |
| 4,815,363 | A | 3/1989 | Harvey |
| 4,883,512 | A | 11/1989 | Griffis |
| 4,893,615 | A | 1/1990 | Khabirova |
| 5,010,777 | A | 4/1991 | Yehl |
| 5,082,471 | A | 1/1992 | Athayde |
| 5,149,190 | A | 9/1992 | MacKenzie |

(Continued)

FOREIGN PATENT DOCUMENTS

| | | |
|---|---|---|
| AU | 766344 | 1/2001 |

(Continued)

OTHER PUBLICATIONS

Moore, Paul, "Miner Protection", Mining Magazine, May 2007, pp. 35-41, Mining Communications Ltd., London, United Kingdom.

(Continued)

*Primary Examiner*—John Kreck
(74) *Attorney, Agent, or Firm*—Senniger Powers LLP

(57) ABSTRACT

A mine refuge for use in a mine includes a chamber sized and shaped for occupancy by at least one miner. An oxygen supply is adapted to be installed in the chamber for supplying oxygen to the chamber. A carbon dioxide reduction system is adapted to be installed in the chamber for reducing carbon dioxide in the chamber. The carbon dioxide reduction system is operable in the mine without an electrical power source.

35 Claims, 38 Drawing Sheets

U.S. PATENT DOCUMENTS

| | | | | |
|---|---|---|---|---|
| 5,165,394 | A | 11/1992 | Hochberg | |
| 5,314,377 | A | 5/1994 | Pelosi, III | |
| 5,326,211 | A | 7/1994 | Critchley | |
| 5,444,944 | A | 8/1995 | Roelofsz | |
| 5,487,380 | A | 1/1996 | Grabenkort | |
| 5,493,818 | A | 2/1996 | Wilson | |
| 5,537,784 | A * | 7/1996 | Baldwin | 52/2.17 |
| 5,596,844 | A | 1/1997 | Kalinowski | |
| 5,622,198 | A | 4/1997 | Elsinger | |
| 5,706,846 | A | 1/1998 | Sutton | |
| 5,727,353 | A | 3/1998 | Getz | |
| 5,749,387 | A | 5/1998 | Thompson | |
| 5,930,961 | A | 8/1999 | Beaudet | |
| 6,178,701 | B1 | 1/2001 | De Paepe | |
| 6,354,457 | B1 | 3/2002 | Aaron | |
| 6,428,680 | B1 | 8/2002 | Kreichauf | |
| 6,565,624 | B2 | 5/2003 | Kutt | |
| 6,623,351 | B2 | 9/2003 | Brown | |
| 6,699,309 | B1 * | 3/2004 | Worthington et al. | 96/108 |
| 6,701,678 | B1 | 3/2004 | Skov | |
| 6,709,483 | B1 | 3/2004 | Hodgson, Jr. | |
| 6,827,760 | B2 | 12/2004 | Kutt | |
| 6,857,956 | B2 | 2/2005 | Fuchs | |
| 6,866,702 | B2 | 3/2005 | Mitsuda | |
| 6,875,119 | B2 | 4/2005 | Murphy | |
| 6,923,716 | B2 | 8/2005 | Koeger | |
| 6,948,280 | B2 | 9/2005 | Marcinkowski | |
| 6,966,937 | B2 | 11/2005 | Yachi | |
| 2002/0092854 | A1 | 7/2002 | Aaron | |
| 2005/0116104 | A1 | 6/2005 | Savin | |
| 2005/0178387 | A1 | 8/2005 | Gurnee | |
| 2007/0193132 | A1 | 8/2007 | Roscioli | |

FOREIGN PATENT DOCUMENTS

| | | | |
|---|---|---|---|
| AU | 200048720 | B2 | 1/2001 |
| CN | 1661198 | | 8/2005 |
| DE | 4207698 | | 9/1993 |
| FR | 2610367 | | 8/1988 |
| GB | 2225040 | | 5/1990 |
| GB | 2309989 | | 8/1997 |
| JP | 7229400 | | 8/1995 |
| JP | 2000186499 | | 5/2000 |
| PL | 173187 | | 8/1995 |
| RU | 2112144 | | 5/1998 |
| WO | 2005052319 | | 6/2005 |
| WO | 2005052319 | A1 | 6/2005 |
| WO | 2005086613 | A2 | 9/2005 |
| WO | 2007084097 | A2 | 7/2007 |
| WO | 2008039347 | A2 | 4/2008 |

OTHER PUBLICATIONS http://web.archive.org/web/20040327233956/www.minearc.com.au/; published 2004.

http://web.archive.org/web/20020206060859/minearc.com.au/air_supply.htm; published 2002.

Refuge Chambers 2005; Government of Western Australia department of Industry and Resources.

Office action dated Jul. 14, 2008 regarding U.S. Appl. No. 11/625,111, 51 pages.

Shairzal Safety Engineering, "Breathing Air System for Escape Vehicles" advertisement, 1 page, Australia.

MineARC Systems, "Refuge Chambers" brochure, 4 pages, Australia.

Strata Products, "AIRDOC Change-Over Station" advertisement, 2 pages, Marietta, GA.

Strata Products, "ExtendAir CO2 Absorbent Curtain" web page, printed from http://www.strataproducts.com/ExtendAirCurtains.html on Jun. 9, 2006, 3 pages, US.

Rana-Medical.com Respiratory Wellness Centre, "For Full Product Information, Please Call (204) 822-6595" web page, printed from http://www.ranamedical.com/refuge.html on Jan. 21, 2006, 2 pages, Canada.

Rana-Medical.com Respiratory Wellness Center, "How It Operates" web page, printed from http://ranamedical.com/refugeop.html on Jan. 21, 2006, 2 pages, Canada.

Rana-Medical.com Respiratory Wellness Centre, "photos" web page, printed from http://ranamedical.com/refugepics.html on Jan. 21, 2006, 3 pages, Canada.

Rana-Medical.com Respiratory Wellness Center, "data" web page, printed from http://www.ranamedical.com/refugedata.html on Jan. 21, 2006, 2 pages, Canada.

Cowan, "Underground Rescue Chambers" web page, printed from http://cowanmfg.com.au/mine_safety/index.htm on Feb. 20, 2006, 2 pages, Australia.

Cowan, "Hyperbaric & Hypobaric Chamber Series" web page, printed from http://cowanmfg.com.au/hyperbaric/index.htm on Feb. 20, 2006, 3 pages, Australia.

Cowan, "Containerised Recompression Chambers" web page, printed from http://cowanmfg.com.au/containerised/index.htm on Feb. 20, 2006, 2 pages, Australia.

Strata Products, "The Portable Fresh Air Bay Portable Inflatable Refuge Chamber" advertisement, 2 pages, US.

Shairzal Safety Engineering, "Mine Refuge Chambers" web page printed from http://www.shairzal.com.au/refuge_units.html on Feb. 16, 2006, 3 pages, Australia.

Gardiner, E.J., et al., "Operation Tommyknocker Test of Survival Equipment for Underground Refuge Stations", 93 pp., Underground Research Laboratory, Lac du Bonnet, Manitoba Mar. 4 & 5, 1993.

West Virginia Office of Miner's Health, Safety and Training, "State Office Approves Shelters for Use in West Virginia Mines", 2 pp., Mar. 9, 2007, West Virginia, United States.

Office of Mine Safety and Health Research and National Personal Protective Technology Laboratory, Performance Evaluation of Portable Refuge Shelters/Chambers, 15 pp., Jun. 22, 2007, Pittsburgh, Pennsylvania.

Stricklin, Kevin G., Program Policy Letter PPL No. P06-V-10, U.S. Department of Labor, Mine Safety and Health Administration, 9 pp., Oct. 24, 2006, Arlington, Virginia, United States.

Stricklin, Kevin G., Program Information Bulletin No. P07-V-03, U.S. Department of Labor, Mine Safety and Health Administration, 48 pp. (includes attachments), Feb. 8, 2007, Arlington, Virginia, United States.

Wooten, Ronald, L., Memo Regarding Approved Shelters, State of West Virginia, 2 pp., Mar. 9, 2007, Charleston, West Virginia, Untied States.

Wooten, Ronald, Letter to H. Jack Henry and Gary Midkiff, West Virginia Approval Letter for Various Shelters, State of West Virginia, Joe Manchin III, Governor, 46 pp., Aug. 18, 2008, Charleston, West Virginia, United States.

Wooten, Ronald. L., Memo Regarding Guidance for Submission of Emergency Shelter Plans, State of West Virginia, Joe Manchin III, Governor, 17 pp., Mar. 15, 2007, Charleston, West Virginia, Untied States.

* cited by examiner

MINE REFUGE

CROSS-REFERENCE TO RELATED APPLICATION

This application claims priority from U.S. Patent Application No. 60/777,021 (provisional), filed Feb. 27, 2006, which is hereby incorporated by reference in its entirety.

U.S. patent application Ser. No. 11/625,111, entitled Mine Refuge, naming William R. Kennedy and John M. Kennedy as inventors, filed simultaneously herewith, is incorporated herein by reference in its entirety.

FIELD

This invention relates generally to a refuge and more particularly to a refuge for use in underground mines.

BACKGROUND

Underground mines possess inherent dangers to miners working in the mine. For one, air quality in underground mines is often threatened by gases released into the mine from the mined geological formation(s), and dust is typically created by equipment used during the mining process. Other occurrences, such as explosions and fires, also may compromise air quality. As a result, underground mines are equipped with air ventilation systems which draw fresh air into the mine to dilute and remove potentially harmful gases (e.g., methane) and dust. Accordingly, fresh outside air is circulated through the mine to bring breathable air to the miners and to remove the gases and dust from the mine.

The safety of the miners in the mine can be threatened if the ventilation system fails to adequately ventilate the mine due to an emergency. When mine ventilation systems fail, miners in the mine are typically evacuated from the mine until proper ventilation can be restored. However, the miners can be placed in peril if they are unable to quickly exit the mine. For example, the miners' exit route may be blocked by fire, smoke, or debris, or the miners may be too disoriented or too injured to escape. Miners trapped in an underground mine without breathable air can find themselves at great risk of substantial injury or even death.

SUMMARY

In one aspect, a mine refuge for use in a mine comprises a chamber sized and shaped for occupancy by at least one miner. An oxygen supply is adapted to be installed in the chamber for supplying oxygen to the chamber. A carbon dioxide reduction system is adapted to be installed in the chamber for reducing carbon dioxide in the chamber. The carbon dioxide reduction system is operable in the mine without an electrical power source.

Various refinements exist of the features noted in relation to the above-mentioned aspects of the present invention. Further features may also be incorporated in the above-mentioned aspects of the present invention as well. These refinements and additional features may exist individually or in any combination. For instance, various features discussed below in relation to any of the illustrated embodiments of the present invention may be incorporated into any of the above-described aspects of the present invention, alone or in any combination.

BRIEF DESCRIPTION OF THE DRAWINGS

Corresponding reference characters indicate corresponding parts throughout the drawings.

DETAILED DESCRIPTION OF THE DRAWINGS

Figure 1:
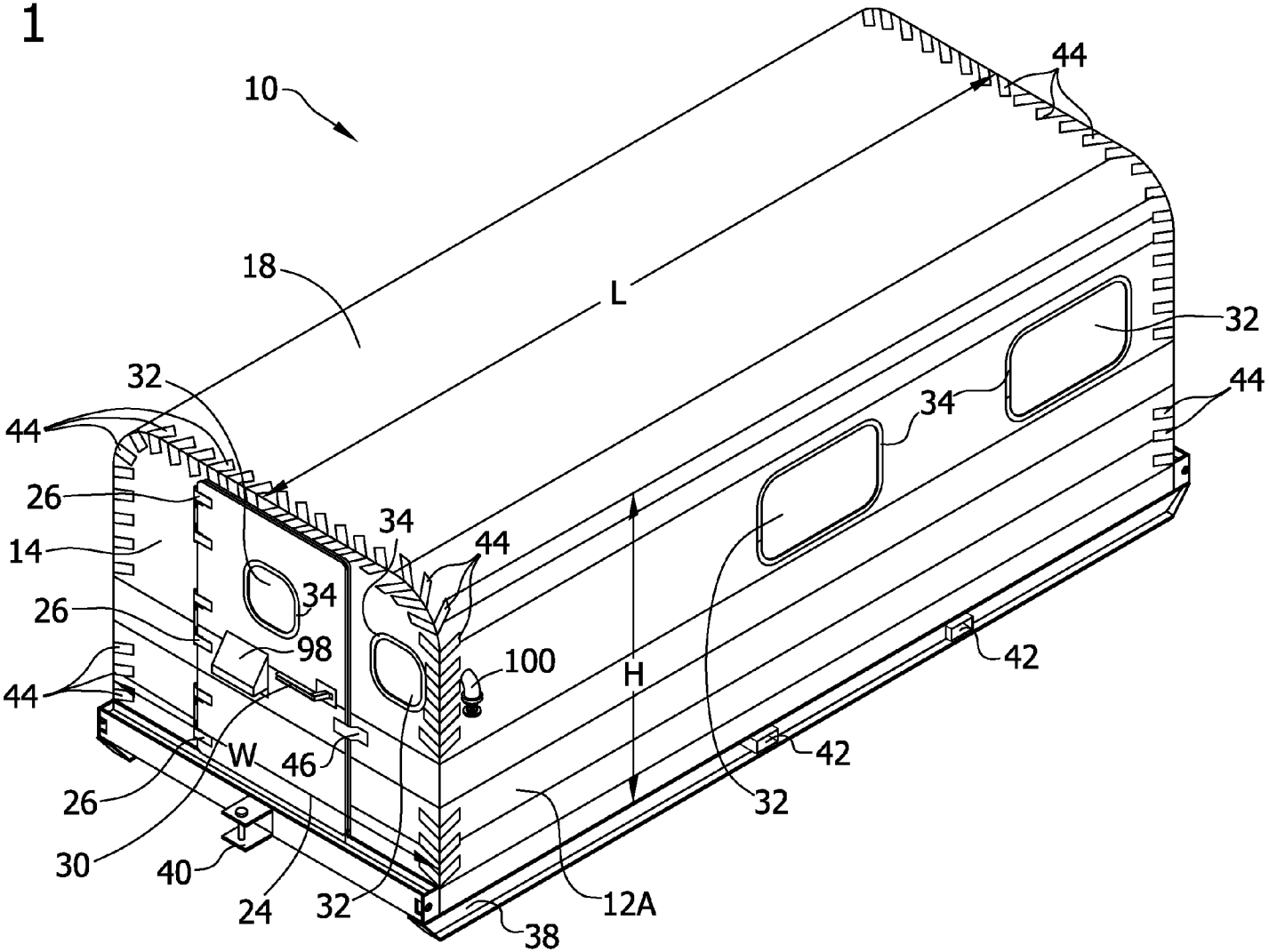
FIG. 1 is a perspective view of one embodiment of a mine refuge of the present invention.

Referring to FIGS. 1-3B, a mine refuge, indicated generally at 10, for use in an underground mine is adapted to receive and provide breathable air and shelter to miners in the event of a mine emergency. The refuge 10 may be placed in the underground mine M in close proximity to areas of the mine in which miners are likely to be located (e.g., a face of the mine, mine transit ways). As a result, the refuge 10 can be quickly and easily accessed by miners should conditions in the mine M warrant such action. For example, miners at the face of the mine M (or elsewhere in the mine) may enter the refuge 10 should the air quality in the mine deteriorate and the miners are unable to safely exit the mine through mine passageways. It is to be understood that numerous refuges can be placed in a single underground mine so that miners working at various locations or traveling through the mine can quickly and easily access one of the refuges. In short, the refuge 10 can be used to provide safe harbor to miners that are trapped in the underground mine M.

The mine refuge 10 comprises side walls 12A, 12B, a front wall 14, a back wall 16, a roof 18, and a floor 20 (broadly, "a base"). In the illustrated embodiment, the walls 12A, 12B, 14, 16, roof 18, and floor 20 are sufficiently robust to withstand rigorous duty within the mine M, especially in coal mines. In the illustrated embodiment, for example, the walls 12A, 12B, 14, 16, roof 18, and floor 20 include a plurality of steel plates welded together to form the refuge 10. It is to be understood that the walls, roof, and floor can have different sized steel plate than those disclosed herein without departing from the scope of this invention or be made from other types of robust material besides steel plates.

Figure 3A:
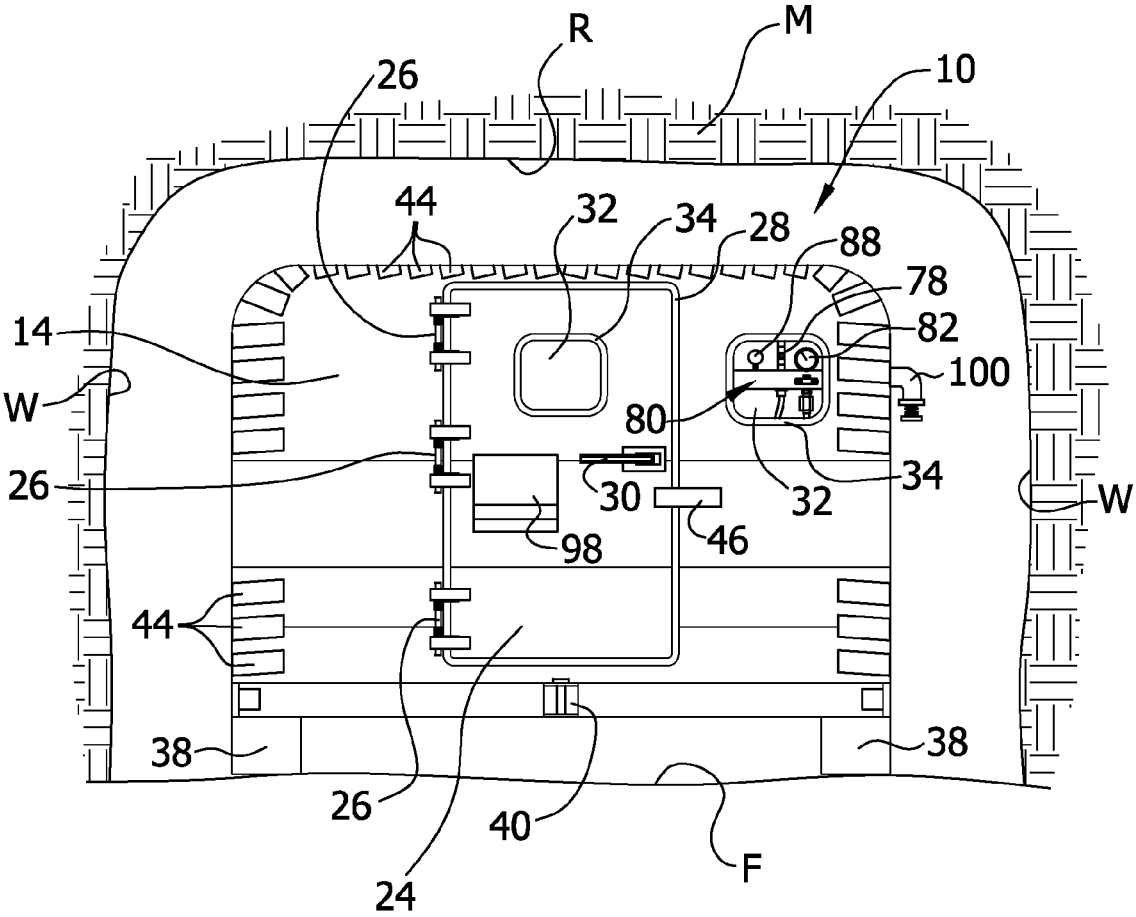
FIG. 3A is a front elevation of the mine refuge with a door in a closed position.
Figure 3B:
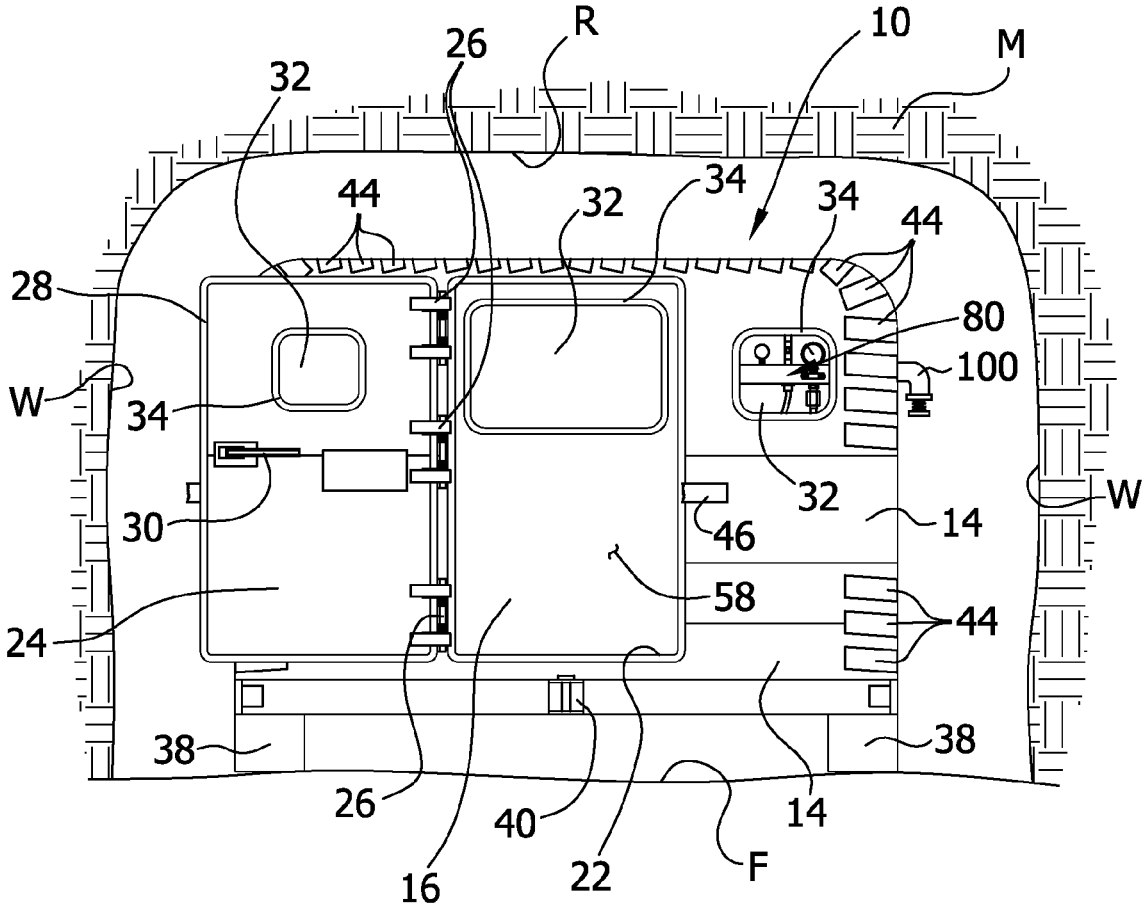
FIG. 3B is the same view as FIG. 3A but with the door in an opened position.

As shown in FIGS. 3A and 3B, the front wall 14 includes a doorway 22 for entry into the refuge 10 by miners (e.g., in the case of a mine emergency). A door 24 is hingedly mounted to the front wall 14 of the refuge 10 adjacent the doorway 22. In the illustrated embodiment, three hinges 26 are used to mount the door 24 but it is to be understood that more or fewer hinges could be used. The door 24 is selectively pivotable about the hinges 26 relative to the refuge 10 between a closed position (FIG. 3A) wherein the door engages the front wall 14 of the refuge around the doorway 22, and an open position (FIG. 3B) wherein the door is swung outwardly away from the refuge for allowing miners to enter and exit the refuge. The outwardly swinging door is more resistant to failure caused by high pressures, which may be present in a mine (e.g., pressures caused by an explosion in the mine). It is understood that the door 24 could alternatively be mounted in the doorway 22 such that the door swings inwardly into the refuge.

The door 24 (and more generally the refuge 10) is generally air-tight so that the refuge can be operated under positive pressure, as further described below. To this end, a rubber seal 28 is preferably attached to the door for sealing against the front wall 14 all around the doorway 22 when the door is closed. Handles 30, which are operatively attached to a latching mechanism (not shown) used to releasably latch the door 24 in the closed position, are mounted on each side of the door so that the door can be opened from either outside or inside the refuge 10.

Figure 5:
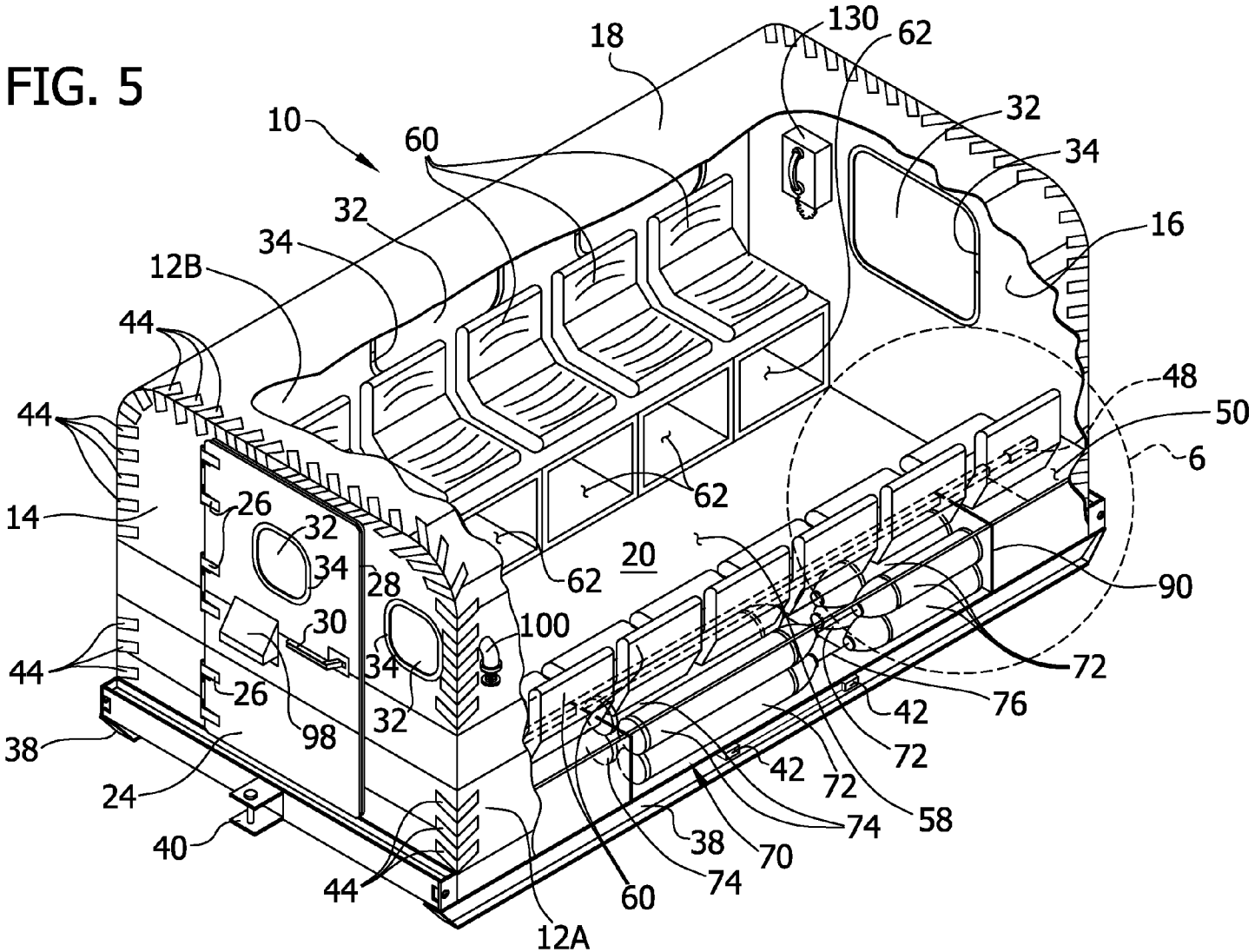
FIG. 5 is a perspective view similar to FIG. 1 except portions of the refuge have been broken away to show an interior chamber of the mine refuge.

With reference to FIGS. 1, 3B, and 5, each of the walls 12A, 12B, 14, 16 of this embodiment includes at least one window 32 for allowing visual observation into and out of the refuge 10. More specifically, the front wall 14 and each of the side walls 12A, 12B includes two windows 32 and the back wall 16 includes a single window. The windows 32 may be made of "wire glass" or another strong, transparent material. It is to be understood that the refuge could have more or fewer windows, including no windows, and that the windows can be arranged in different configurations than those illustrated herein. It is also to be understood that the windows can have different shapes and sizes than those illustrated herein.

Figure 4:
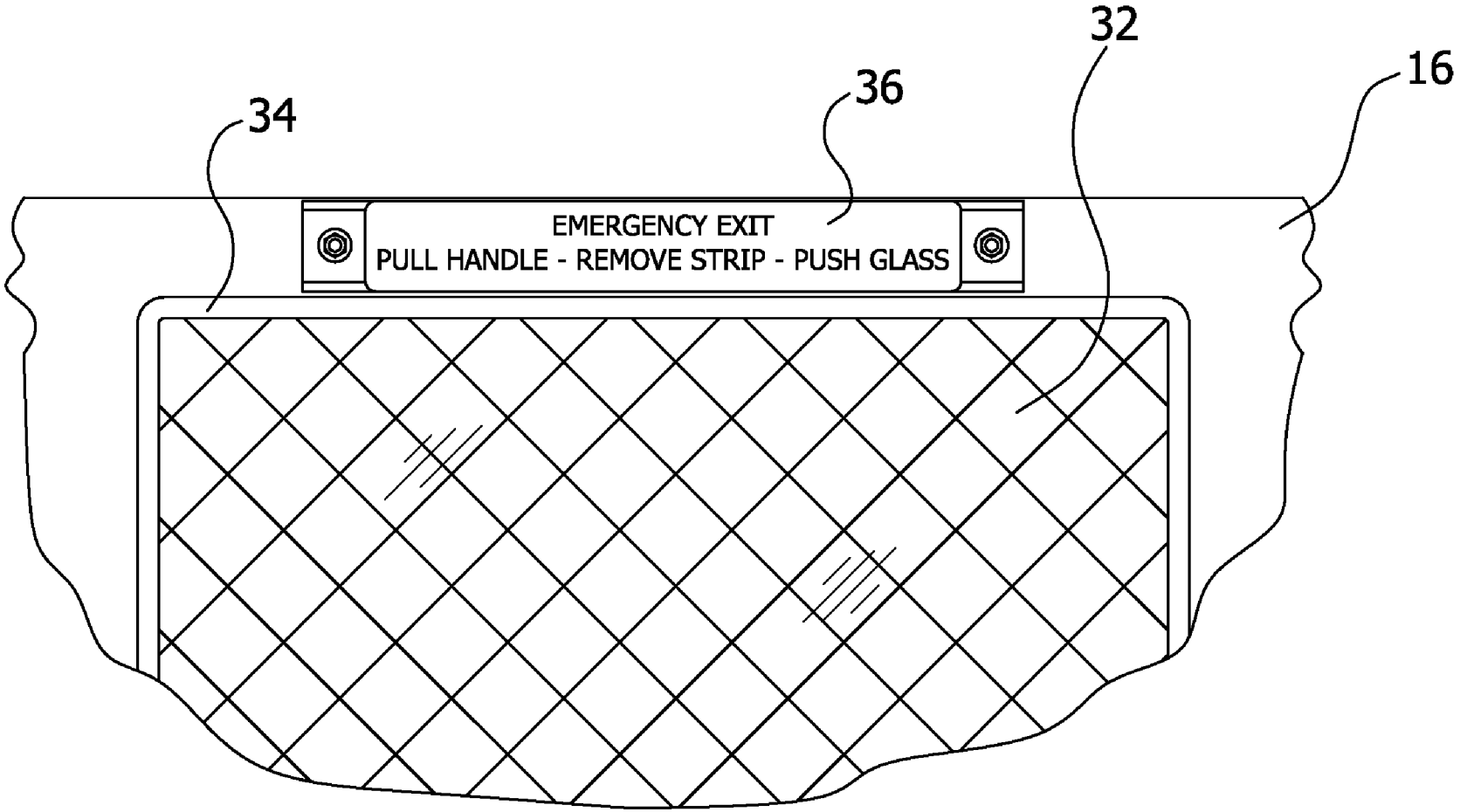
FIG. 4 is an enlarged fragmentary elevation view of an emergency exit window in the mine refuge.

As shown in FIG. 4, suitable seals or gaskets 34 are provided around each of the windows 32. In one embodiment, the gasket 34 around at least one (or all) of the windows 32 is an emergency exit rubber gasket, similar to that used on buses and trains. In the illustrated embodiment, for example, each of the windows 32 in the side walls 12A, 12B and the back wall 16 are prepared as emergency exits. The windows 32 prepared as emergency exits include an emergency handle 36 that can be pulled to pull out a 'key' strip that holds the rubber gasket 34 tight against the glass and window frame so that the glass can be removed. Emergency exits are useful, for example, in the event of a mine roof R fall or if the doorway 22 is otherwise impassable. The window openings are large enough to allow the miners to exit through the window opening. It is also contemplated that a second door (not shown) can be installed in the refuge to provide a secondary or emergency exit.

Figure 4A:
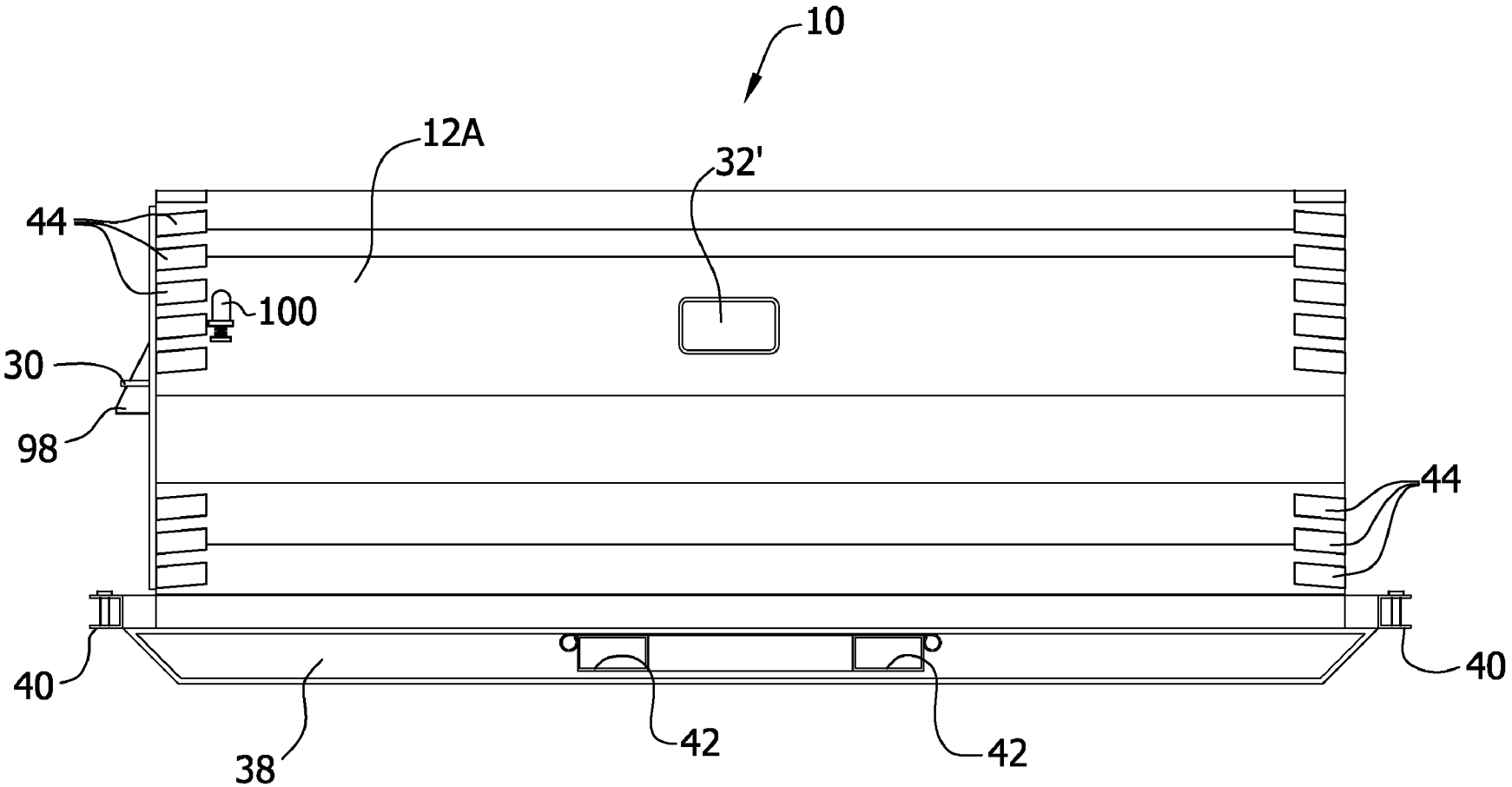
FIG. 4A is a side elevation of the mine refuge similar to FIG. 2 but showing another configuration of a window.

The mine refuge 10 shown in FIG. 4A includes smaller windows 32' that are able to withstand greater pressures than those illustrated in the previous figures. For example, the windows 32' of this configuration can withstand pressures of 15 psi or greater without failing. The windows 32' are installed in the refuge 10 in a manner similar to how a windshield is installed in an automobile. More specifically, the window 32' is slightly larger than the opening in the refuge so that a periphery of the window overlaps the opening. The window 32' is retained by Z-shaped members and is set in RTV silicone rubber.

Figure 5A:
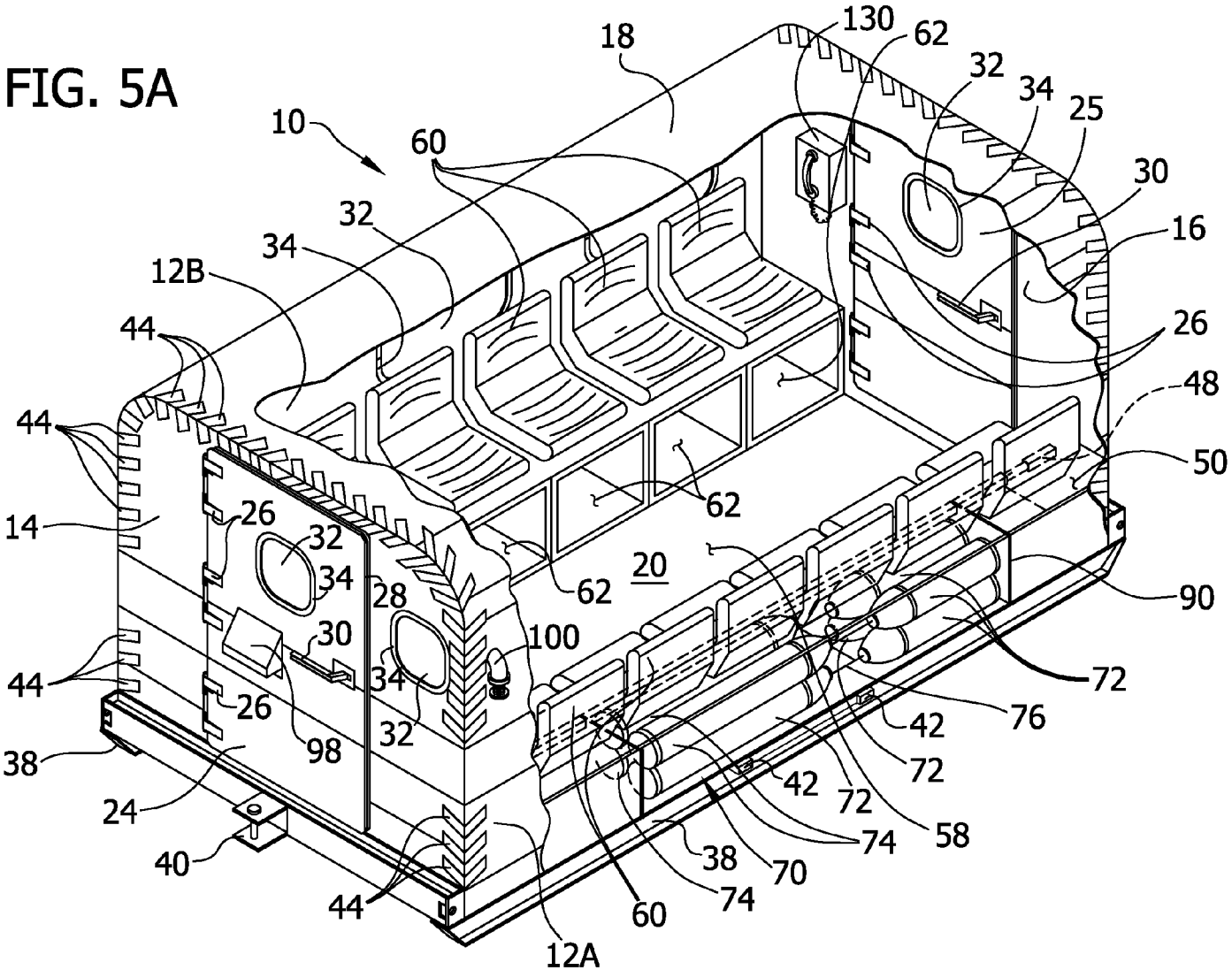
FIG. 5A is a perspective view similar to FIG. 5 but showing the refuge with a second door.
Figure 5B:
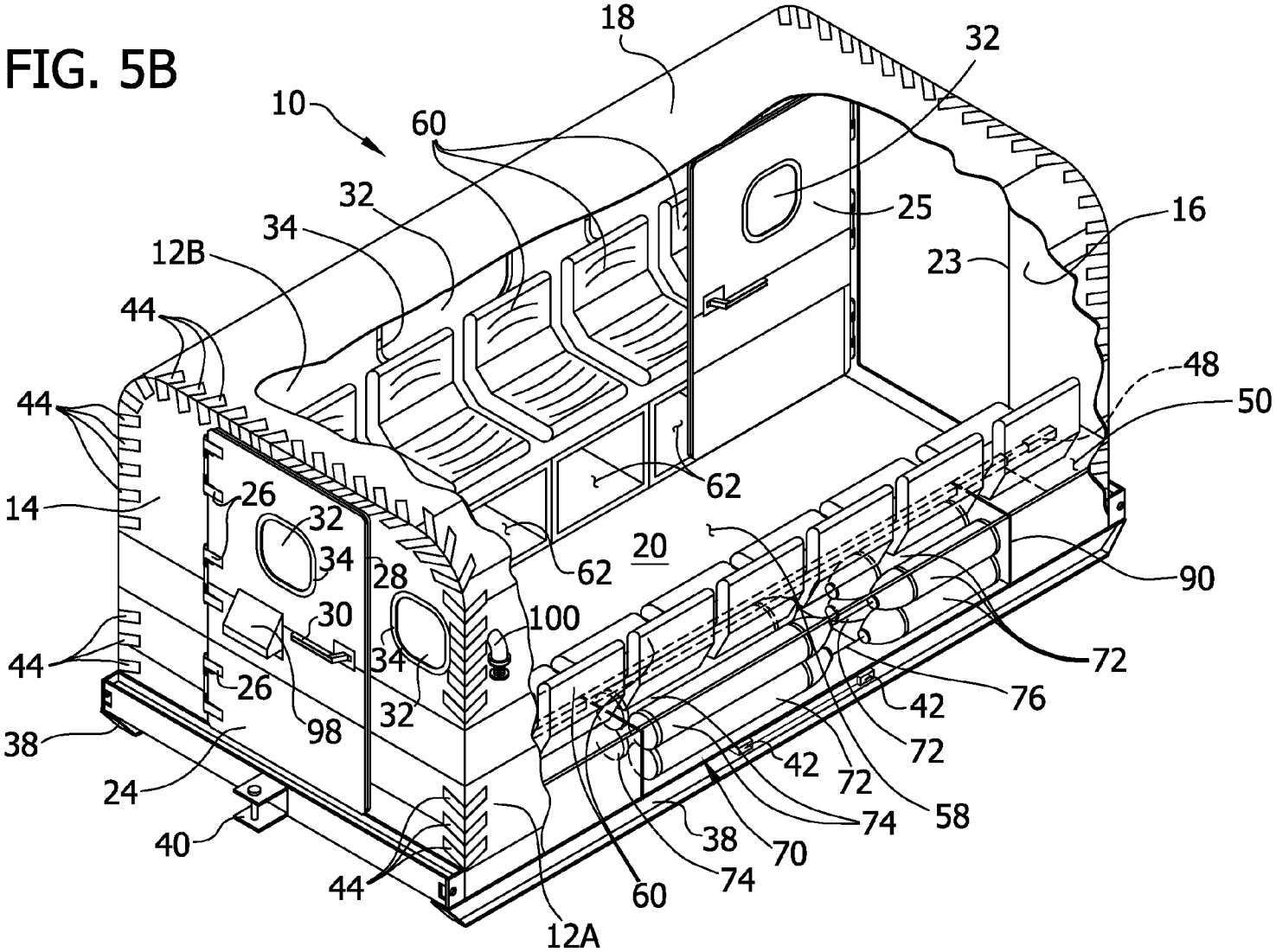
FIG. 5B is a perspective view similar to FIG. 5A but showing the second door in an open position.

In another configuration (FIGS. 5A and 5B), the mine refuge 10 includes a second door 25 mounted in a doorway 23 in the back wall 16. The second door 25 is substantially the same as the door 24 mounted to the front wall 14 of the refuge 10 except that the second door swings inwardly into the refuge. The second door 25 swings inwardly so that if pressure is greater in the mine than in the refuge, the door can be readily opened without having to overcome the mine pressure. The inwardly swinging door 25 also facilitates a better seal, therefore making it easier to maintain a positive pressure within the refuge 10. Positively pressurizing the refuge 10 is described in more detail below. The second door 25 can provide a secondary entrance into and exit from the refuge 10 or can provide an emergency exit from the refuge, e.g., in case of a roof collapse.

Figure 2:
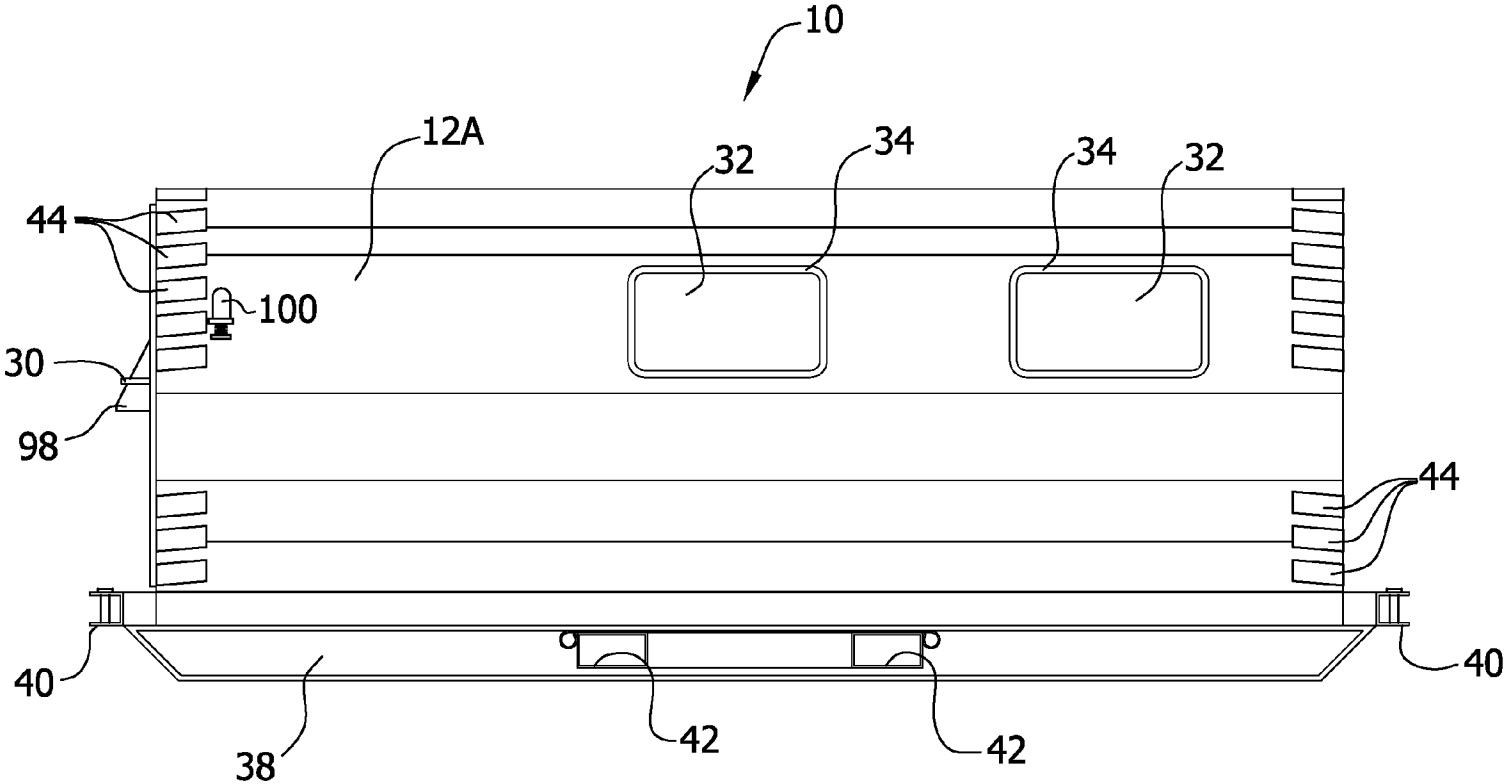
FIG. 2 is a side elevation of the mine refuge.

With reference to FIGS. 1 and 2, the illustrated refuge 10 is mounted on a mine duty skid 38 suitable for repeated dragging or transporting to various locations in the mine M, e.g., to follow the workers as the face of the mine is advanced. The refuge 10 includes two hitches 40: one of the hitches is adjacent the front wall 14 and the other hitch is adjacent the back wall 16 for allowing the refuge to be attached to a truck or other suitable equipment at either end of the refuge for dragging the refuge through the mine M. The skid 38 can include spaced openings 42 sized and shaped for receiving forks of a forklift for lifting and transporting the refuge 10. It is contemplated that the refuge can be mounted in other ways including on rubber tires or rail wheels. It is also contemplated that the refuge can be otherwise mounted, e.g., on a truck, especially for mines with high clearance such as high seam thickness mines. In low seam thickness mines, the refuge can be skid free. That is, the floor of the refuge can be placed in direct contact with the mine floor.

The height, length, and width of the refuge 10 can be varied as desired to accommodate different number of miners and different mine conditions. The illustrated mine refuge 10, for example, has a height H of about 5.5 feet, a width W of about 8 feet, and a length L of about 10 feet. The height H of the refuge 10 can be between about 8 feet and about 5 feet. The height H of the refuge 10 can even be less than 5 feet to facilitate dragging the refuge through a low underground mine, especially through a low coal seam mine. In one embodiment, the height H of the refuge 10 is sized to between about 75% to about 95% the height of the mine M in which the refuge is intended to be located. The width W of the refuge 10 can be between about 12 feet (or even more) and about 7 feet (or even less) depending on the conditions in the underground mine.

Typically, a refuge having two rows of seats is sized such that one foot of length of refuge is provided for each anticipated miner. For example, a 10 foot long refuge 10 (shown) having two rows of seats would be able to accommodate up to ten miners whereas a 12 foot long refuge would be able to accommodate up to twelve miners. A wider refuge having three rows of seats is sized such that two foot of length of refuge is provided for three miners. Thus, a 10 foot long refuge having three rows of seats would be able to accommodate up to fifteen miners whereas a 12 foot long refuge would be able to accommodate up to eighteen miners. It is to be understood that the refuge could have different heights, widths, and lengths than those disclosed herein without departing from the scope of this invention.

With reference still to FIGS. 1 and 2, the walls 12A, 12B, 14, 16 and roof 18 of the refuge 10 have reflective stickers 44 attached thereto to increase the visibility of the refuge and thereby facilitate locating the refuge by miners and mine rescuers in low light conditions, which are often experienced in underground mines. Moreover, the walls 12A, 12B, 14, 16 of the refuge 10 or portions thereof can be painted in a highly visible color (e.g. yellow, orange) to also facilitate locating the refuge. It is contemplated the other types of visual indicators (e.g., flashing lights) and/or audio indicators (e.g., an alarm) can be used to facilitate locating the refuge.

Referring again to FIGS. 3A and 3B, the refuge 10 can include a tamperproof seal 46 that has to be ruptured before entering the refuge. In the illustrated embodiment, the tamperproof seal 46 is a frangible sticker that extends between the door 24 and the portion of the front wall 14 adjacent the door (FIG. 3A). Thus, when the door 24 is opened, the seal 46 is broken (FIG. 3B). The seal 46, while not inhibiting entry into the refuge 10, is an inexpensive inspection tool in that so long as the seal remains intact an inspector knows that the refuge 10 has not been entered. If the seal 46 is ruptured, however, the inspector will know that a thorough inspection of the refuge 10 is needed to ensure that its contents are in good working order and accounted for. Accordingly, the seal 46 deters miners from entering the refuge 10 except in the event of an emergency and, in the event the refuge is entered, the ruptured seal provides indication of such entry. It is to be understood that other types of tamperproof seals besides stickers can be used.

Figure 6:
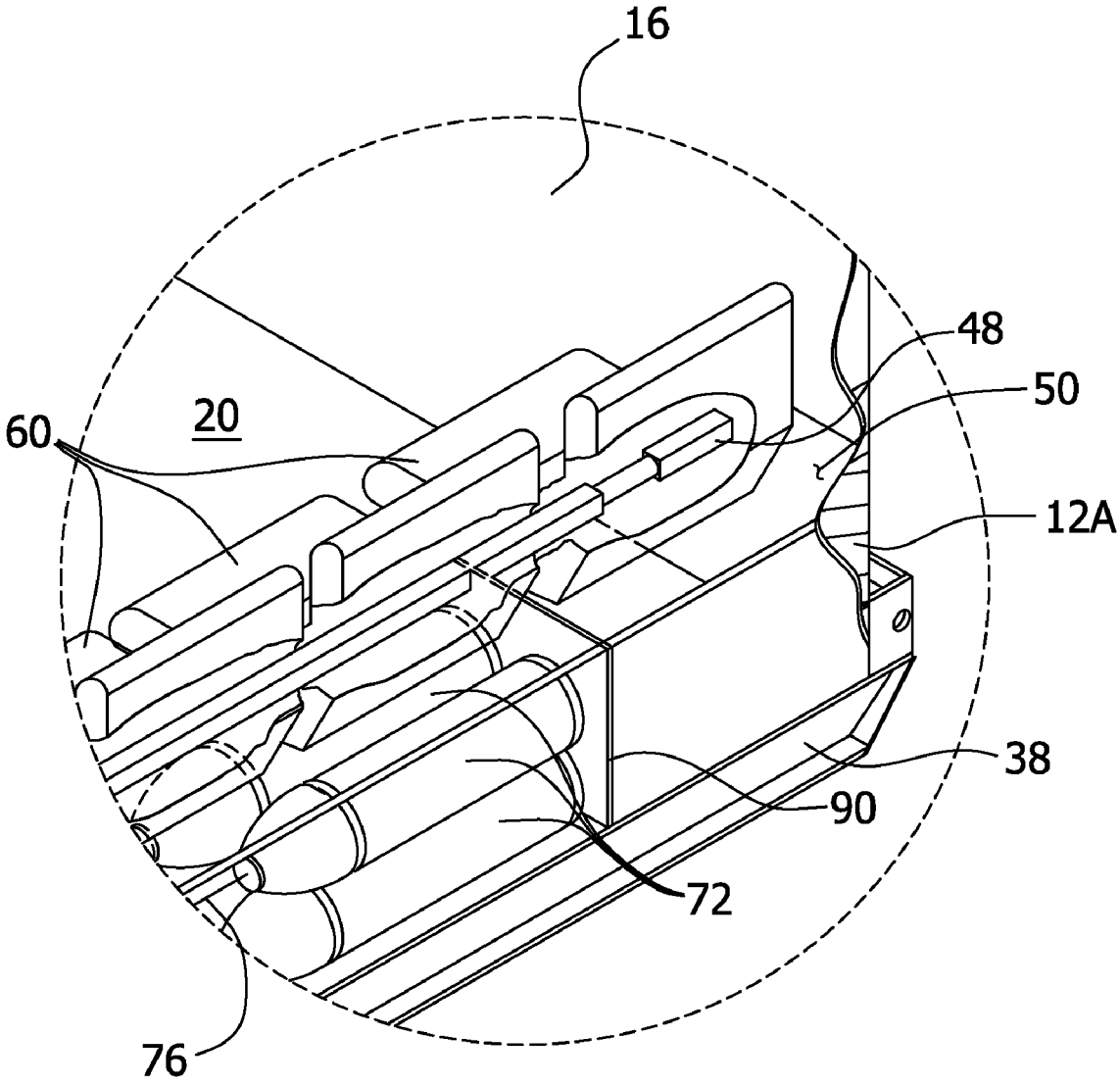
FIG. 6 is an enlarged perspective view of a telescoping tube of a energy absorbing system.

With reference now to FIGS. 5 and 6, the refuge 10 contains an energy absorbing system for protecting the contents of the refuge by absorbing the force in the event the refuge is impacted, e.g., if the refuge is hit by mine equipment. The energy absorbing system comprises telescoping tubes 48 (one being shown) that provide a crush zone 50 in the refuge 50. In the event one of the ends of the refuge 10 (i.e., the front or back walls 14, 16) is impacted, the telescoping tubes 48 will retract allowing the crush zone 50 of the refuge to collapse or to be crushed. The impact, however, has less effect on the other portions of the refuge 10 than it would have if not for the crush zone 50. Moreover, the crush zone 50 deflects the impact away from the oxygen supply system 70 discussed below. It is to be understood that more than one telescoping tube can be used and that multiple telescoping tubes can be placed on both ends of the refuge and on the sides of the refuge.

Figure 7:
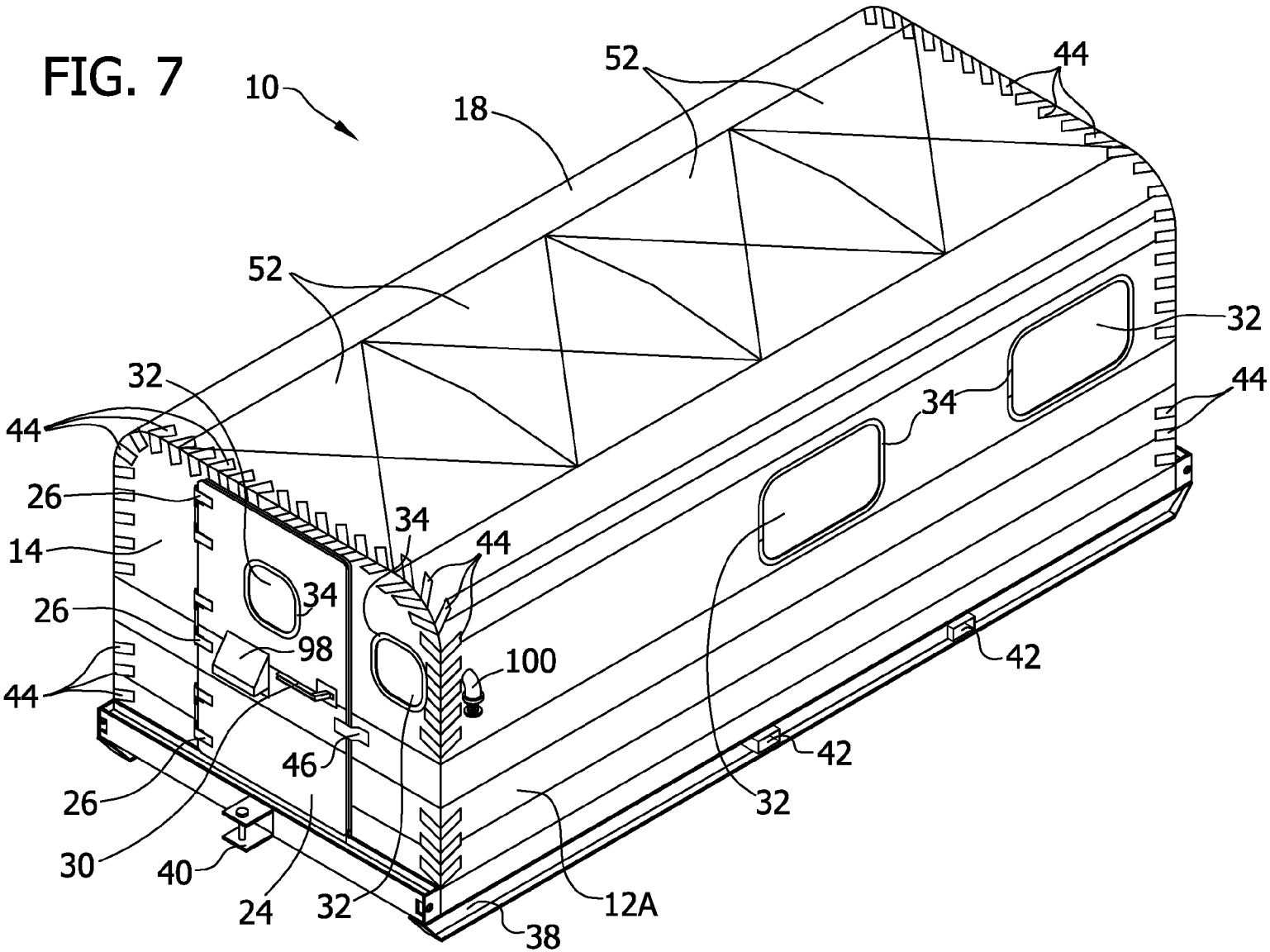
FIG. 7 is a perspective view of a refuge having cross-formed roof panels.

FIG. 7 illustrates a roof embodiment having cross-formed roof panels 52 that also serve as an energy absorbing system. The cross-formed roof panels 52, which are generally arch-shaped, allow relief in the event the refuge 10 is impacted (e.g., bent or collapsed) from the sides or ends of the refuge. The cross-formed roof panels 52 do however provide good vertical strength. If the refuge 10 is partially crushed, the cross-formed roof panels will buckle uniformly upward and with a fixed resistance. Without the cross-formed roof panels, the roof of the refuge 10 would fold more easily and in a more unpredictable manner. The cross-formed panels 52 can be used with, or without the telescoping tubes 48.

Figure 8:
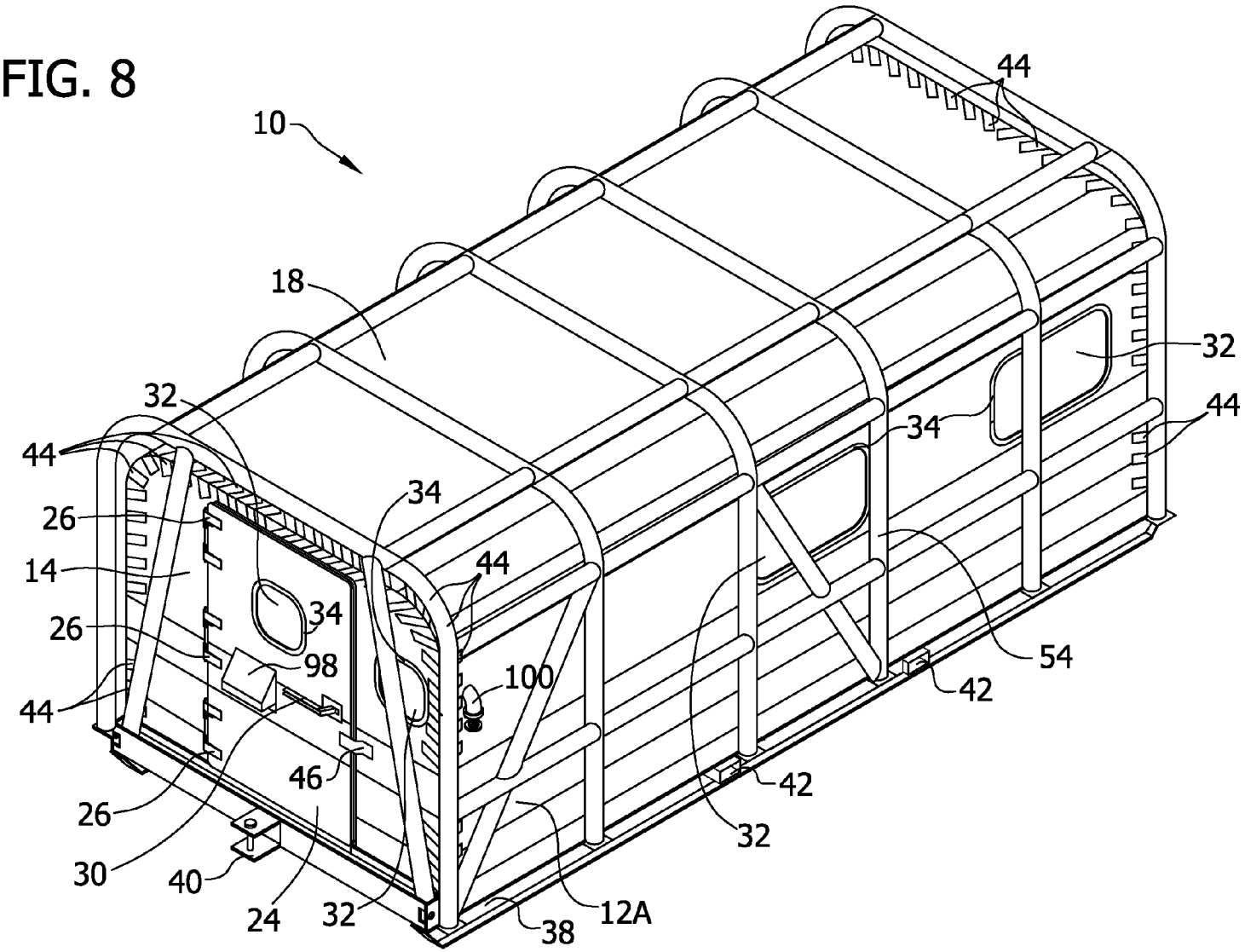
FIG. 8 is a perspective view of the mine refuge having a protective pipe cage surrounding the refuge.
Figure 9:
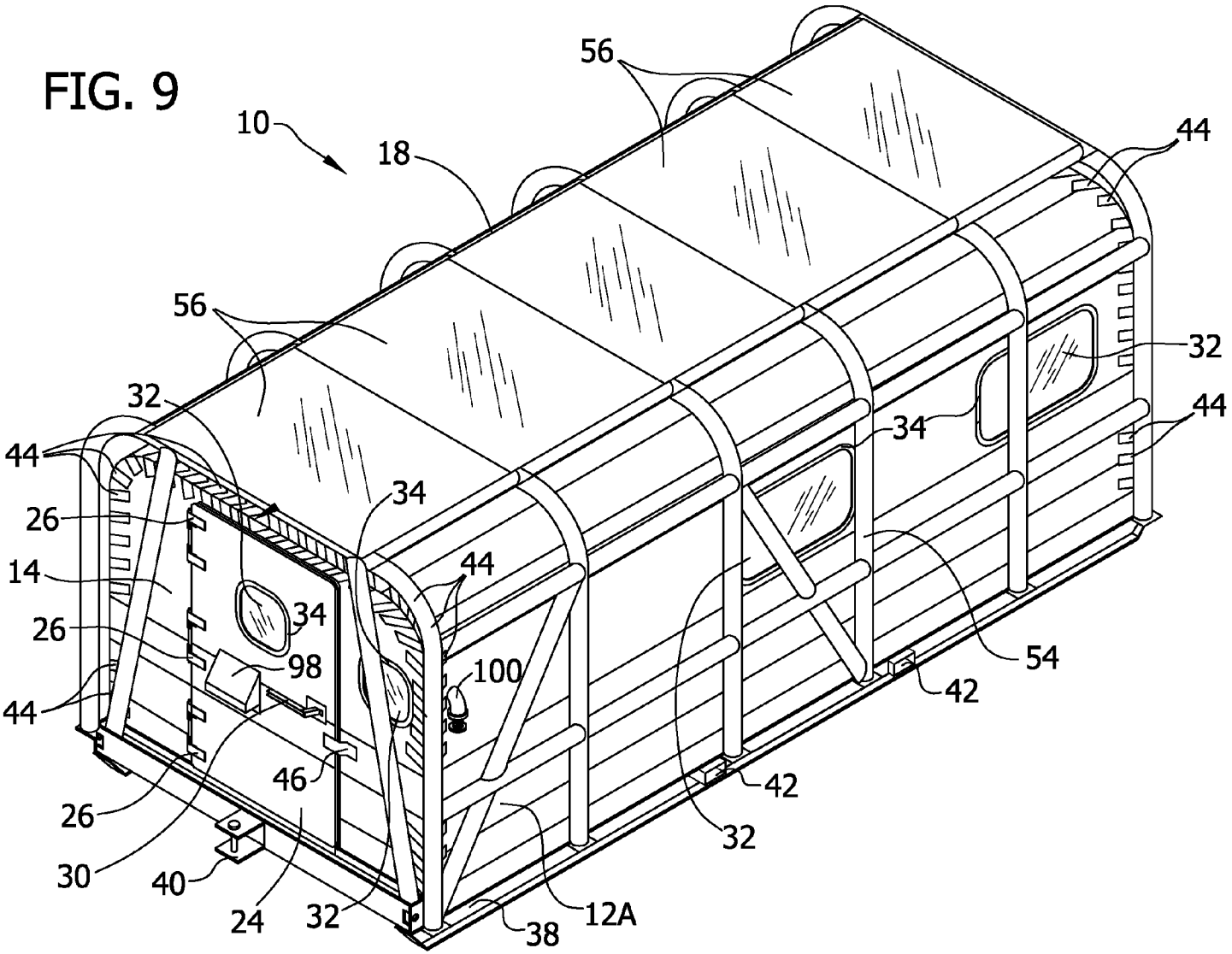
FIG. 9 is a perspective view similar to FIG. 8 but metal plates are shown supported by the pipe cage.

As shown in FIG. 8, the refuge 10 can be protected from damage by enclosing the refuge in a pipe cage 54. The illustrated pipe cage 54 is formed of 3 inch diameter steel pipe but it is contemplated that other diameter steel pipe and/or other robust materials can be used to form the cage. The illustrated cage 54 is spaced about 2 inches from the refuge so that the cage can be stressed without impacting the refuge 10. Rigidity can be added to the cage 54 by attaching roof debris protection plates 56 to the top of the cage (FIG. 9). The roof debris protection plates 56 also prevent debris, which may fall from the mine roof R, from contacting and potentially damaging the refuge 10.

With reference again to FIG. 5, the side walls 12A, 12B, front and back walls 14, 16, roof 18, and floor 20 cooperatively define an interior chamber 58 sized and shaped for receiving at least one miner therein. A portion of one of the side walls 12A and the roof 18 of the refuge 10 is broken away in FIG. 5 to show the chamber 58. The illustrated chamber, for example, is sized and shaped for receiving ten miners therein but it is understood that the chamber can be shaped to receive more or fewer miners. The illustrated chamber 58 has a generally rectangular shape formed by the front and back walls 14, 16, which are generally equally sized squares, the side walls 12A, 12B, which are generally equally sized rectangles, and the roof 18 and floor 20, which are also generally equally sized rectangles. It is to be understood that the chamber can have other shapes and configurations within the scope of the invention.

The illustrated chamber 58 also includes accommodations for receiving ten miners therein for an extended period of time (e.g., 100 hours). As shown, the chamber 58 has ten seats 60 in a two row configuration for providing each of the miners a place to sit down. It is contemplated that any number of seats may be included within the chamber or that the seats can have different arrangements. For example, a wider refuge (e.g., 12 feet wide) may be provided with three rows of seats. It is to be understood that one or both rows of seats could be replaced with benches. It is further understood that the refuge could be provided without seats. For example, refuges designed for low coal seams may have a height of about 24 inches, which is too low to accommodate a miner in a seating position. Instead, the miners would need to be in a prone or near prone position in the refuge.

Moreover, the chamber 58 includes an area for allowing at least some of the miners received in the chamber to lay down to sleep or otherwise rest. In the illustrated configuration, a sufficient amount of floor 20 space is provided between the seats 60 for allowing at least one of the miners room to lie down to sleep. A back board (not shown) can also be provided for lying across one of the rows of seats to provide additional sleeping space. If benches are used instead of seats, miners can lie down on the benches. It is understood that some miners will be able to sleep while seated and/or that the miners will sleep in shifts. Accordingly, the chamber does not need to have sufficient space to allow all of the miners sufficient space to lie down and sleep at the same time. However, a chamber with sufficient space for doing so would not be outside the scope of this invention. It is contemplated that other types of sleeping arrangements can be provided for in the chamber (e.g., hammocks that can be suspended from the roof).

As shown in FIG. 5, space is provided under each of the seats 60 for storage. Storage containers 62 can be placed in this space for storing provisions (i.e., water, food, carbon dioxide scrubbers as described below, self-rescuers, etc.) beneath the seats 60. The storage containers 62 can contain other items as well. For example, reading materials (e.g., books, magazines), pencils, paper, games, playing cards, flashlights (e.g., 300 hour permissible flashlights), toilet paper, first aid kit, splints, backboard, and/or refuge repair materials (e.g., acrylic windows, duct tape) can be stored in the storage containers. It is to be understood that more or fewer items can be provided in the containers.

Figure 10A:
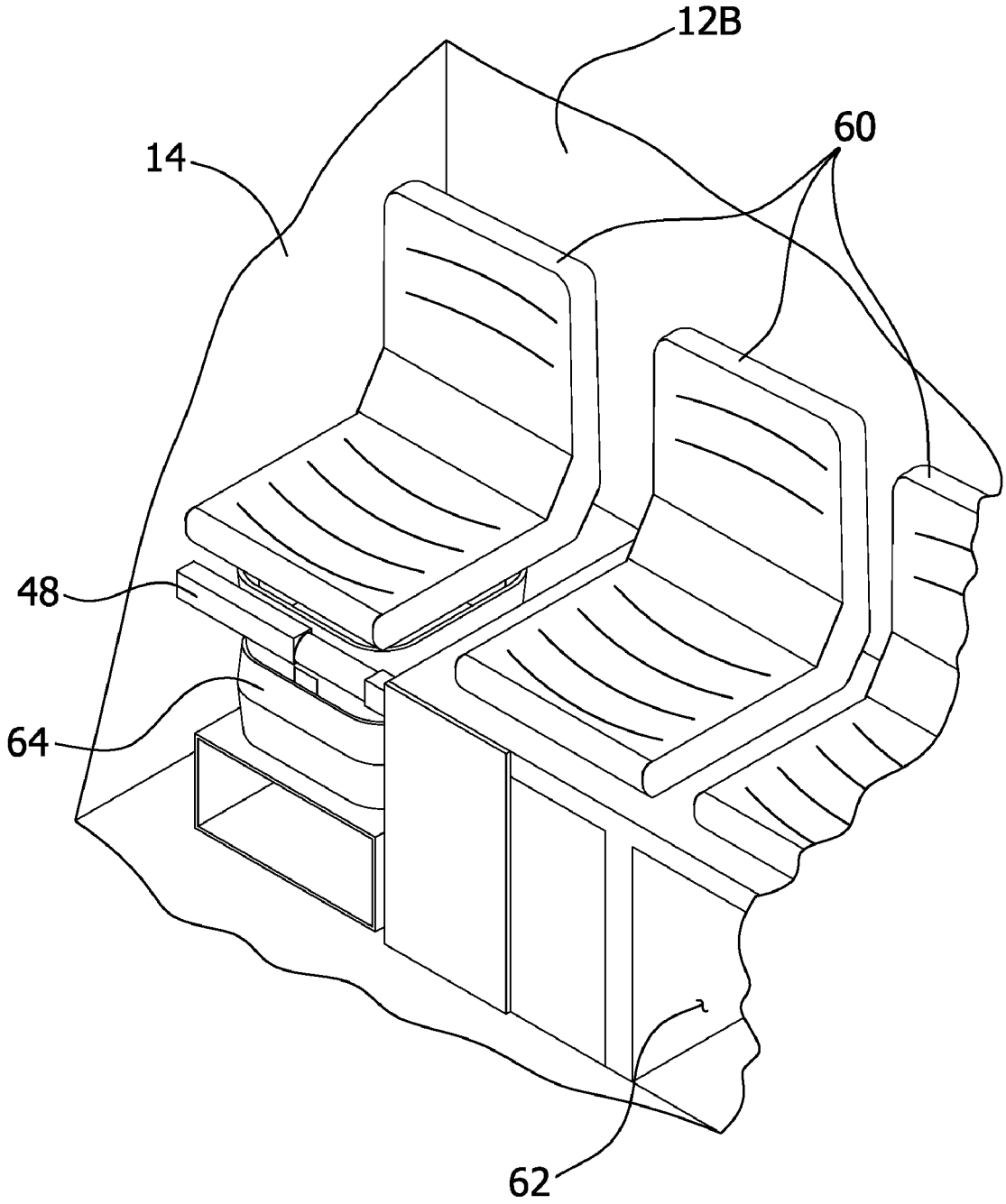
FIG. 10A is a fragmentary perspective view of the chamber showing a toilet in a stowed position.
Figure 10B:
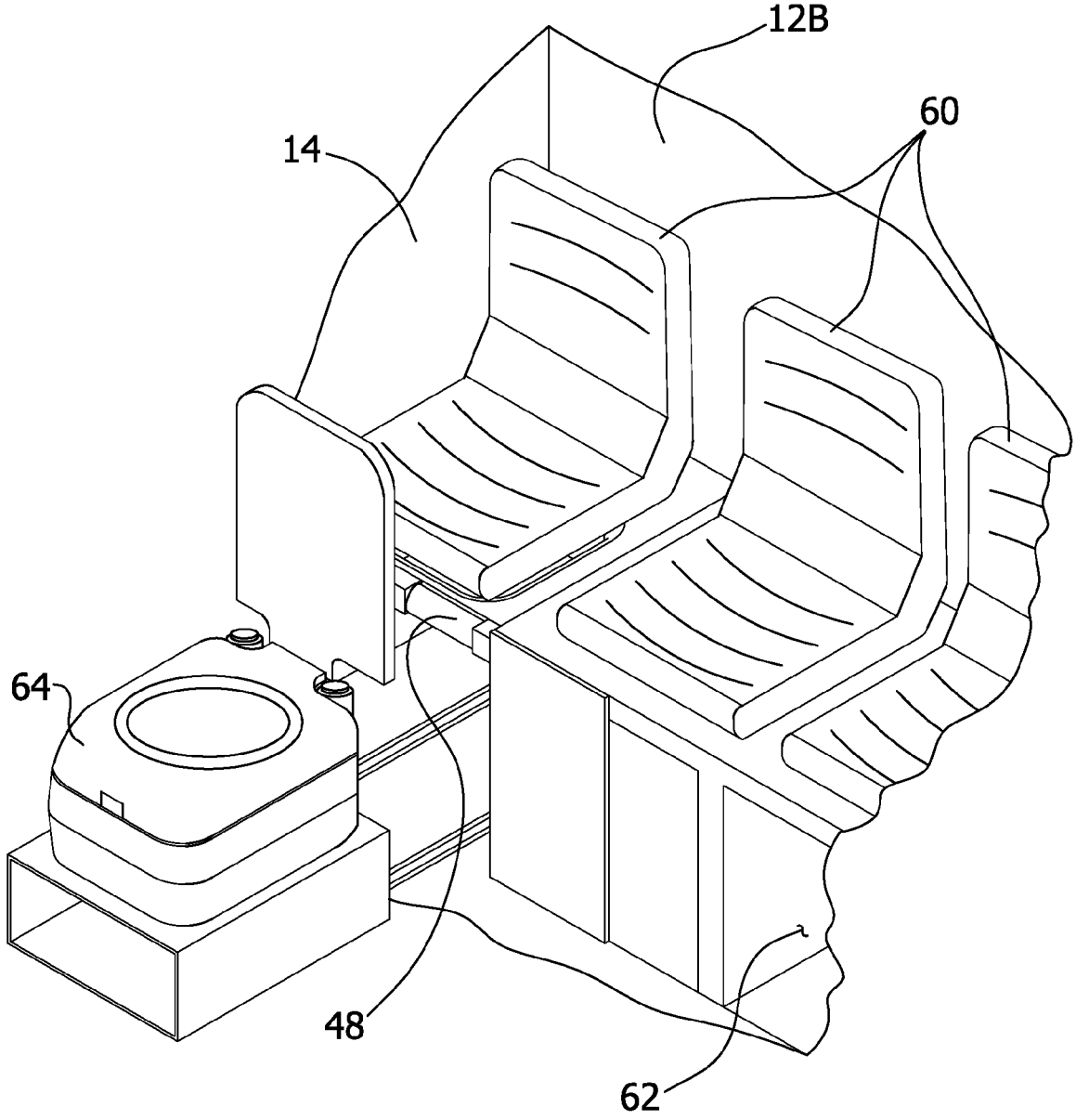
FIG. 10B is a fragmentary perspective similar to FIG. 10A but showing the toilet in a ready for use position.
Figure 11:
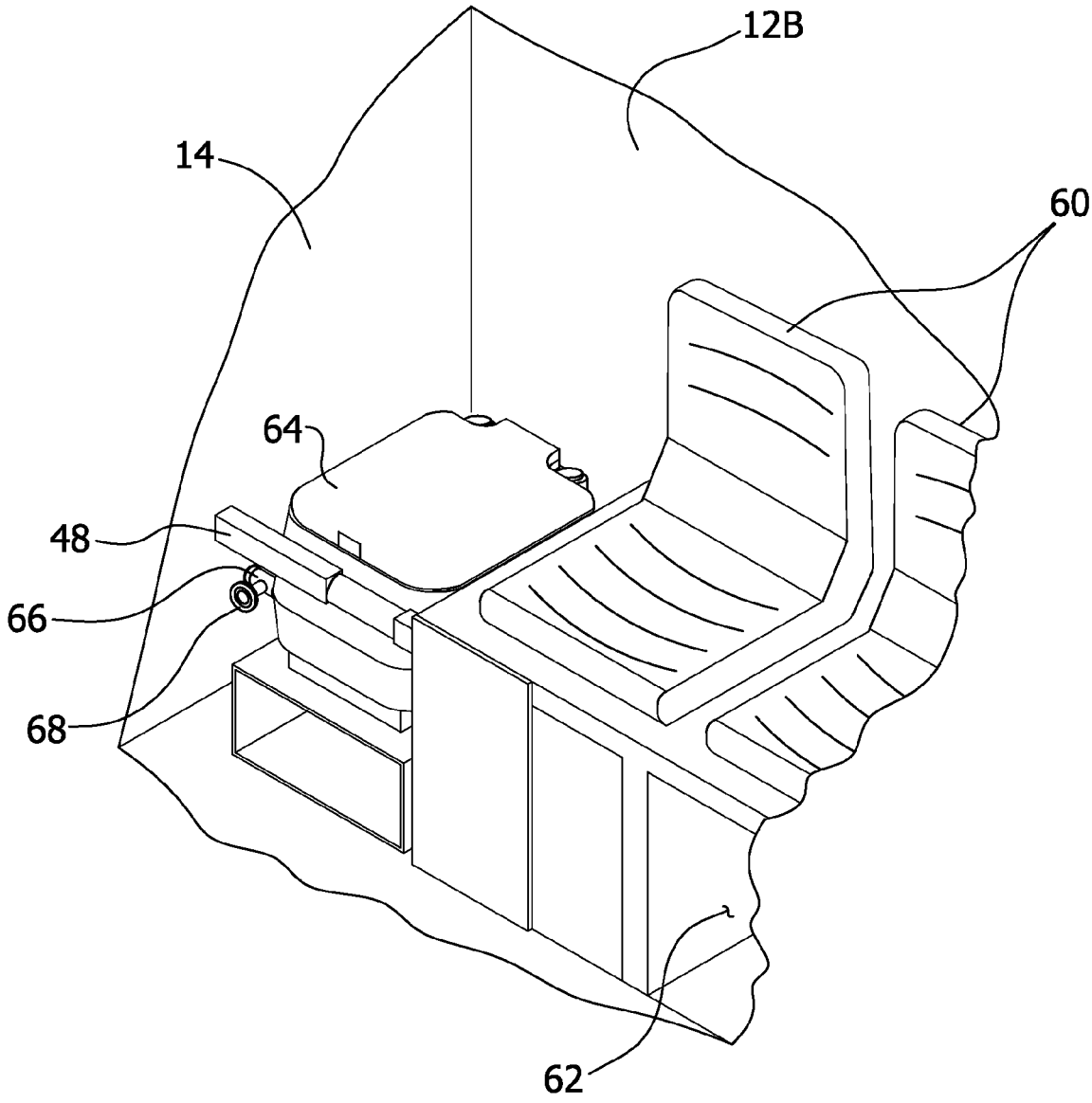
FIG. 11 is a fragmentary perspective view similar to FIG. 10A but showing another embodiment of a toilet.

As shown in FIGS. 10A and 10B, a waste receptacle (e.g., a chemical toilet 64) is also stored under the seats 60. In the illustrated embodiment, the toilet 64 can be pulled out from under the seats 60, used, and slid back under the seats until it is needed again. In one embodiment, the toilet 64 can be a chemical toilet containing a chemical solution for neutralizing any waste therein. In another embodiment illustrated in FIG. 11, a toilet 64' can be piped and thereby drained to a location outside of the refuge 10. In this embodiment, a drain pipe 66 fluidly connects the toilet 64' to a location outside the refuge. A valve 68 blocks the drain pipe 66 when not in use to inhibit the loss of pressure within the chamber 58 or allow potentially contaminated air outside the chamber from entering the chamber. A removable seat (not shown) can be placed over the toilet 64' when it is not in use. It is to be understood that other types of waste receptacles or toilets could be used in the refuge.

The interior walls of the chamber 58 may be painted white (or other suitable colors) for lighting efficiency. Lights powered by various means may be mounted inside and/or outside the chamber.

Figure 12:
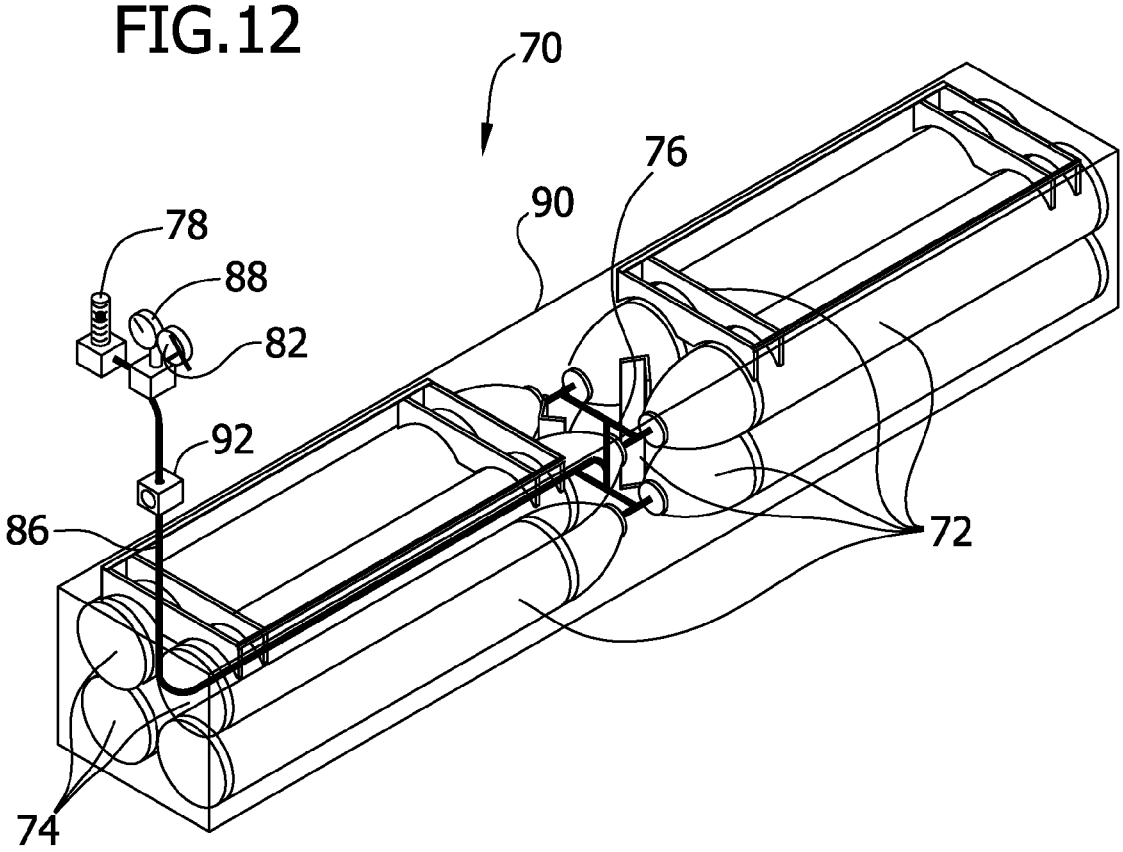
FIG. 12 is a perspective view of an oxygen supply system.
Figure 13:
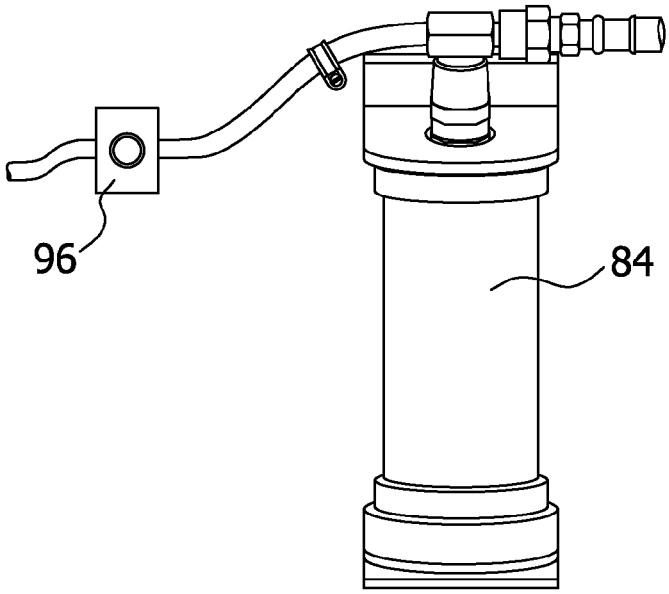
FIG. 13 is an elevation view of a muffler for the oxygen supply system.
Figure 14A:
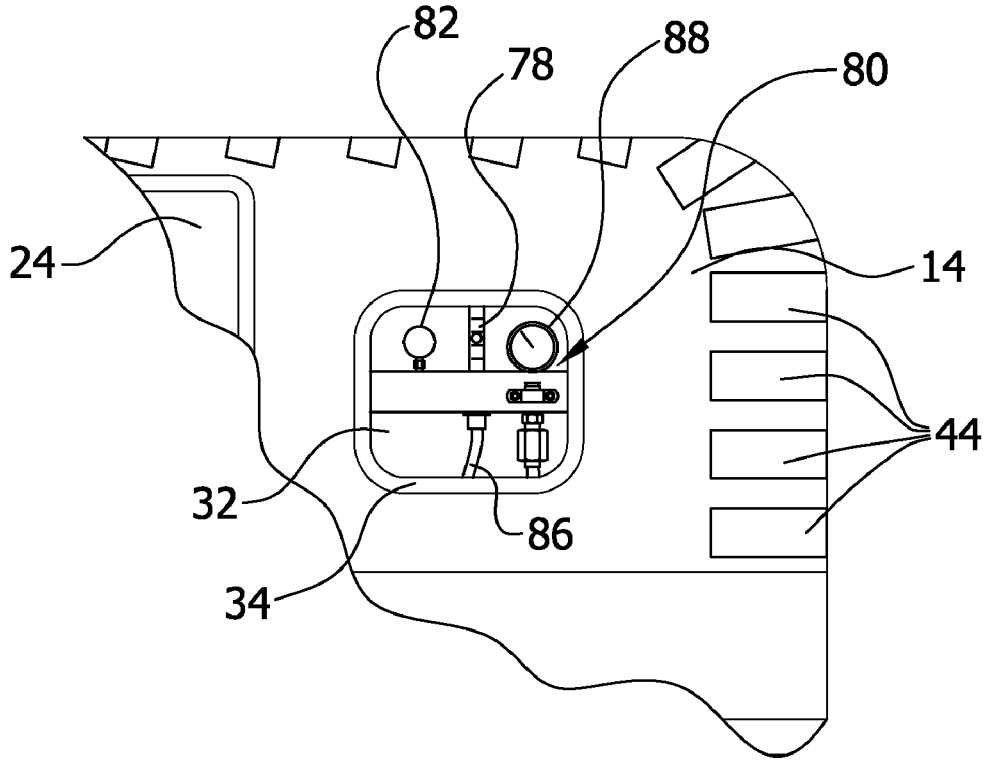
FIG. 14A is an enlarged elevation view of a portion of the mine refuge showing gauges for the oxygen supply system being visible through a window in the mine refuge.
Figure 14B:
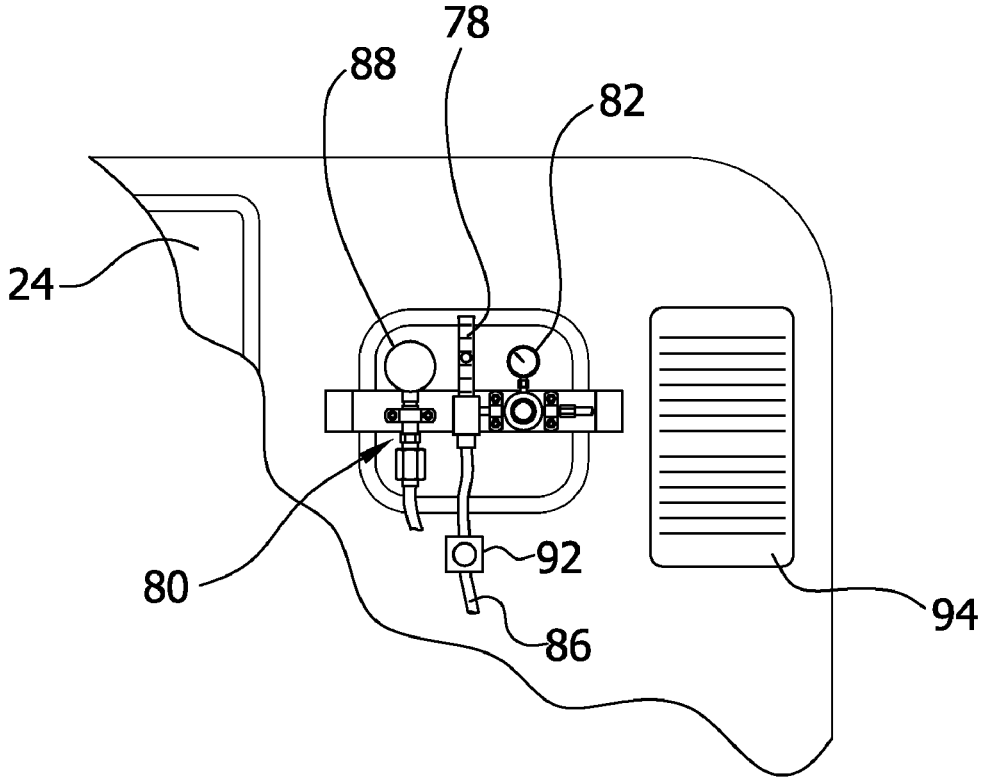
FIG. 14B is an enlarged elevation view similar to FIG. 7A but showing the gauges for the oxygen supply system being visible from within the interior of the mine refuge.

With reference to FIGS. 5 and 12-14B, the refuge 10 includes an oxygen supply system 70 for supplying oxygen to the miners during use of the refuge. The illustrated oxygen supply system 70 includes a plurality of oxygen cylinders 72 (five being shown), at least one purge cylinder 74 (three being shown), a manifold 76, a flow meter 78, an oxygen regulator 80, and a muffler 84. The oxygen cylinders 72 are connected to the manifold 76, and a single line 86 from the manifold is in turn connected to the flow meter 78 and the oxygen regulator 80 (FIG. 12). The regulator 80 includes a "contents" gauge 82 (e.g., a pressure gauge) that displays the remaining pressure in the oxygen supply system 70 (FIGS. 14A and 14B). In one example, the cylinder pressure goes from approximately 2200 PSI to 0 PSI at whatever flow rate is selected for the regulator 80. It is understood that in some configurations of the refuge the purge cylinders and muffler can be removed from the oxygen supply system.

Referring again to FIG. 5, the oxygen cylinders 72 of the oxygen supply system 70 are stored under the seats 60. In the illustrated configuration, five "K" sized oxygen cylinders 72 are stored under the row of seats across from the row of seats having the storage containers 62 thereunder. It is contemplated that the oxygen cylinders 72 or additional cylinders may be stored near the roof 18 or elsewhere in the refuge 10 (e.g., see FIG. 20). It is contemplated that the refuge can have more or fewer oxygen cylinders.

A cylinder restraining system 90 (broadly, "an oxygen supply support system"), also located under the seats 60 in the illustrated configuration, maintains the oxygen cylinders 72 and their respective valves in position to inhibit or prevent the cylinders and valves from impacting each other or other objects (FIG. 12). In other words, the cylinder restraining system 90 holds the cylinders 72 in place and thereby protects them from damage. In the illustrated embodiment, the purge cylinders 74 are also held in place by the cylinder restraining system 90.

As shown in FIGS. 3A, 3B, 14A, and 14B, one of the windows 32 in the front wall 14 may be used to quickly check the status of the oxygen supply system 70 and the provisions in the chamber 58, e.g., to make sure they have not been tampered with. This facilitates keeping the chamber 58 sealed and the tamperproof seal 46 intact except in an emergency. By remaining sealed, there is less chance that anyone may tamper with the chamber 58, e.g., provisions and the oxygen supply system 70. It is also contemplated to have just one "contents" gauge at the window, visible from inside and outside, or to have two gauges at the window.

As mentioned, the oxygen supply system 70 is used to provide oxygen and thus breathable air to the miners received within the chamber 58 of the refuge 10. The oxygen supply system 70 can adjusted to correlate the amount of oxygen being supplied into the chamber 58 to the number of miners located in the chamber. Too little or too much oxygen supplied to the chamber 58 may be detrimental to the miners' health. For example, too little oxygen may cause hypoxia. Too much oxygen, on the other hand, may cause oxygen toxicity, create a fire hazard and at the least consume the limited supply oxygen available.

The rate at which oxygen is supplied to the chamber 58 can be regulated using a selector 92 (FIG. 14B). The selector 92 allows the miners within the chamber 58 to select the proper flow of oxygen for the number of miners received in the chamber. Typically, the flow of oxygen from the oxygen cylinders 72 is about 0.5 liters per minute (LPM) per occupant. As a result, the miners can use the selector 92 to adjust the oxygen flow as measured by the flow meter 78 to the correct flow rate. In one embodiment, a placard 94 is provided within the chamber 58 that provides the proper flow rates for the potential number of miners in the chamber. For example, the placard 94 can be used to provide the following information.

| Number of Miners | Flow Meter Setting |
|---|---|
| 1 | 0.5 LPM |
| 2 | 1.0 LPM |
| 3 | 1.5 LPM |
| 4 | 2.0 LPM |
| 5 | 2.5 LPM |
| 6 | 3.0 LPM |
| 7 | 3.5 LPM |
| 8 | 4.0 LPM |
| 9 | 4.5 LPM |
| 10 | 5.0 LPM |
| 11 | 5.5 LPM |
| 12 | 6.0 LPM |
| 13 | 6.5 LPM |
| 14 | 7.0 LPM |
| 15 | 7.5 LPM |
| 16 | 8.0 LPM |
| 17 | 8.5 LPM |
| 18 | 9.0 LPM |
| 19 | 9.5 LPM |
| 20 | 10.0 LPM |
| 21 | 10.5 LPM |
| 22 | 11.0 LPM |
| 23 | 11.5 LPM |
| 24 | 12.0 LPM |
| 25 | 12.5 LPM |
| 26 | 13.0 LPM |
| 27 | 13.5 LPM |
| 28 | 14.0 LPM |

The total volume of oxygen provided in the refuge varies depending on the size of the chamber 58 and thereby the number of miners for which the chamber is adapted to receive. In other words, larger chambers adapted to receive more miners will be provided with a greater volume of oxygen than smaller chambers adapted to receive fewer miners. In the illustrated embodiment, the chamber is provided with five "K" size cylinders 72 which are able to provide enough oxygen to 10 miners for at least about 100 hours. This quantity of oxygen would be able to provide 5 miners enough oxygen for at least about 200 hours, and 20 miners enough oxygen for at least about 50 hours. Thus, the duration that the oxygen supply will last is directly dependent on the number of miners received the in the chamber 58. It is contemplated that more or fewer oxygen cylinders 72 can be provided in the chamber to select the number of hours of oxygen supply for a given number of miners.

It is also contemplated to include masks that can be used to supply breathable air to miners in the refuge. The masks can be used as the primary source of breathable air to the miners. That is, during use of the refuge, each of the miners therein would don a mask in order to receive oxygen. Optionally, the masks can be provided as a secondary or backup means of breathable air for the miners. In this arrangement, breathable air would be provided to the entire refuge but the mask could be selectively worn by the miners. Miners in the refuge can don the oxygen masks if the air quality in the refuge becomes contaminated. A particular occupant with respiratory, heart, or other health problems might wear one to provide additional oxygen or better quality air than in the chamber environment.

In the embodiment illustrated in FIGS. 5 and 12, three purge cylinders 74 are also located under the row of seats and disposed in the cylinder restraining system 90. The purge cylinders 74 contain breathable air and are used to positively pressurize the chamber 58. The purge cylinders 74 can be rapidly evacuated to purge the chamber 58. Rapid purging of the chamber 58 is effective to quickly provide breathable air conditions within the chamber by reducing any potential contamination in the air that may enter the chamber (e.g., if the door 24 had been opened). The muffler 84 is provided to dampen the noise associated with rapidly evacuating one or more of the purge cylinders 74 (FIG. 13). It is contemplated that the chamber can be provided with more or fewer than three purge cylinders.

The purge cylinders 74 can be adjusted to a suitable flow rate using a selector 96 to maintain a positive pressure within the chamber 58. For example, the chamber 58 can be maintained under a positive pressure of about 0.1 to about 2 IWG. The positive pressure ensures that potentially contaminated mine air does not enter the chamber 58 as explained in move detail below. With reference again to FIG. 1, a pressure relief vent 98 is located in the refuge 10 for venting and ensuring that the pressure within the refuge does not become excessive. In the illustrated embodiment, the vent 98 is located on the door 24 of the refuge 10 but it is contemplated that the vent can be located elsewhere. The vent includes a hinged steel flap that is spring biased by a calibrated spring to the closed position. A rubber seal is provided to prevent leakage adjacent the flap.

In addition, a pressure relief valve 100 extends outward from one of the side walls 12A to ensure the pressure inside the chamber does not become too great. The pressure relief valve 100 can be set to open at a threshold value (e.g., 0.1 to 2 IWG), and to remain shut or return to a shut position under a pressure equal to or less than the threshold valve. In one embodiment, the rubber gaskets 34 around one or more of the windows 32 may provide an automatic emergency pressure relief, e.g., where the oxygen or purge air flows too rapidly into the chamber 58. It is understood that the pressure relief valve 100 can be mounted on any wall of the refuge and may have other configurations. It is also contemplated that the pressure relief valve 100 can be eliminated in some configurations of the refuge.

Figure 15:
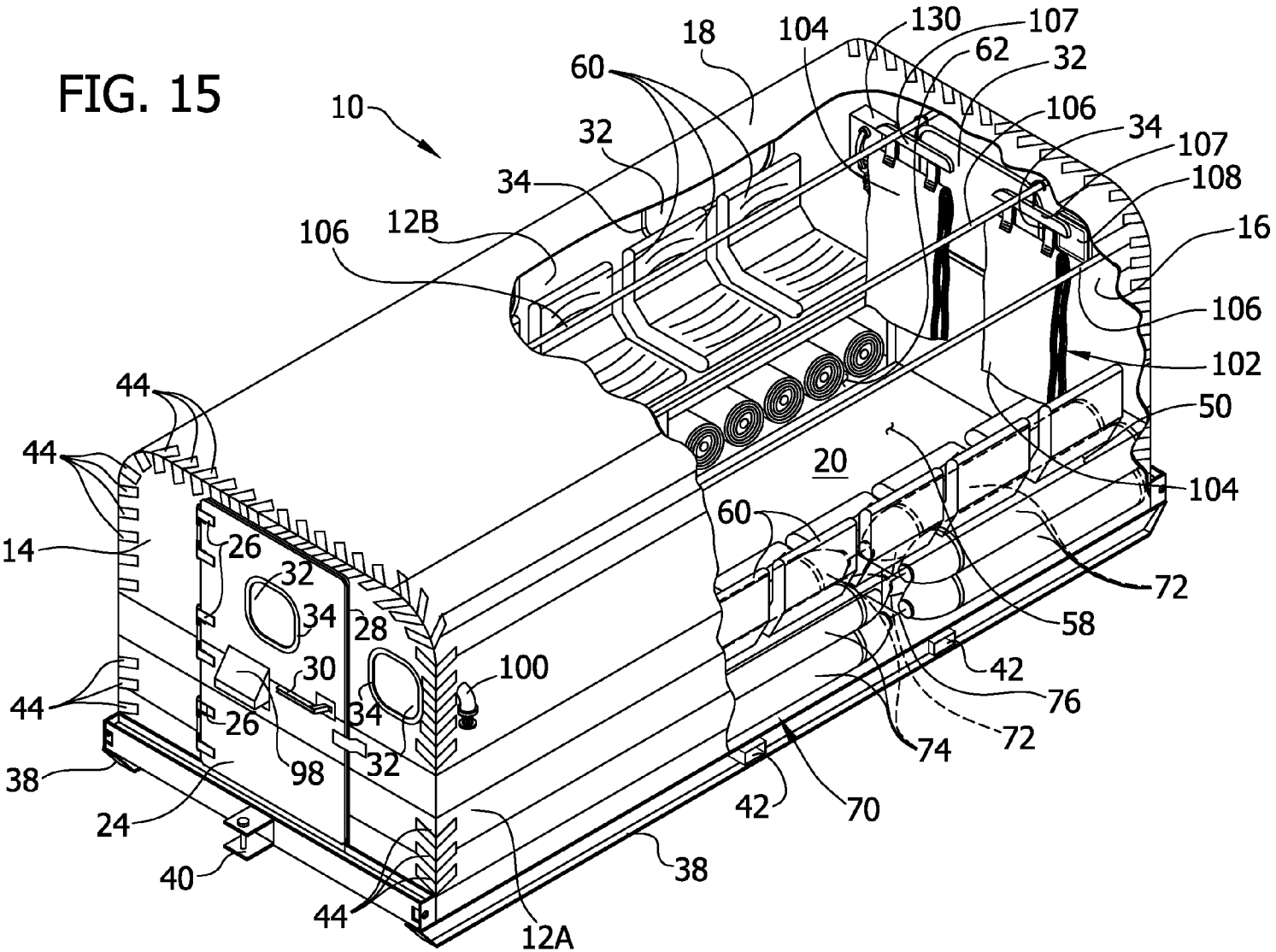
FIG. 15 is a perspective view of the mine refuge with portions broken away to show a carbon dioxide reduction system.

Referring to FIG. 15, the chamber 58 also includes a carbon dioxide reduction system 102 or "scrubber" to capture carbon dioxide expelled by the miners during respiration or otherwise present in the chamber 58. In the illustrated embodiment, the reduction system 102 is a passive system including carbon dioxide absorbing sheets 104. The sheets include lithium hydroxide contained in a web (e.g., polyethylene or the like), such as available from Micropore of Newark, Del. under the tradename EXTENDAIR CO2 absorbent curtain. The sheets 104 may be in packaged rolls, similar to rolls of paper towels. The reaction of the low pH carbon dioxide and high pH lithium hydroxide results in a generally neutral reaction product, lithium carbonate. The packaged sheets 104 can be stored under the seats 60, e.g., as illustrated in FIG. 15, in one or more of the storage containers 62, or in other ways. The minimum number of sheets 104 exposed during use of the chamber 58 depends on the number of miners in the chamber. Instructions can be provided in the chamber 58 indicating the minimum number of sheets 104 to be exposed per the number of miners received in the chamber. It is also contemplated that the number of sheets exposed can be fixed and not dependent on the number of miners received in the chamber.

With reference still to FIG. 15, the sheets 104 can be suspended in generally vertical direction (i.e., curtain-like)

from the top of the chamber 58, e.g., from a "roof rack". The rack may include clips, wires, cables, rods or the like disposed near the ceiling of the chamber 58. In the illustrated embodiment, the rack includes long rods 106 extending adjacent the ceiling from the back wall 16 to the front wall 14. The sheets 104 can be suspended by draping the sheets over the rods 106 or using hangers 107 as is shown in FIG. 15. Other positions and orientations of the carbon dioxide absorbing sheets are also contemplated (e.g., horizontally between the rods).

Figure 16A:
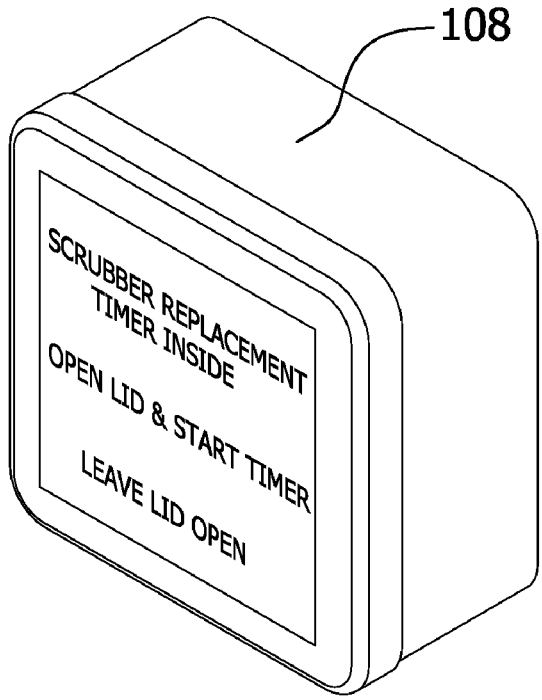
FIG. 16A is an enlarged perspective view of a housing for a timer for the scrubber system.
Figure 16B:
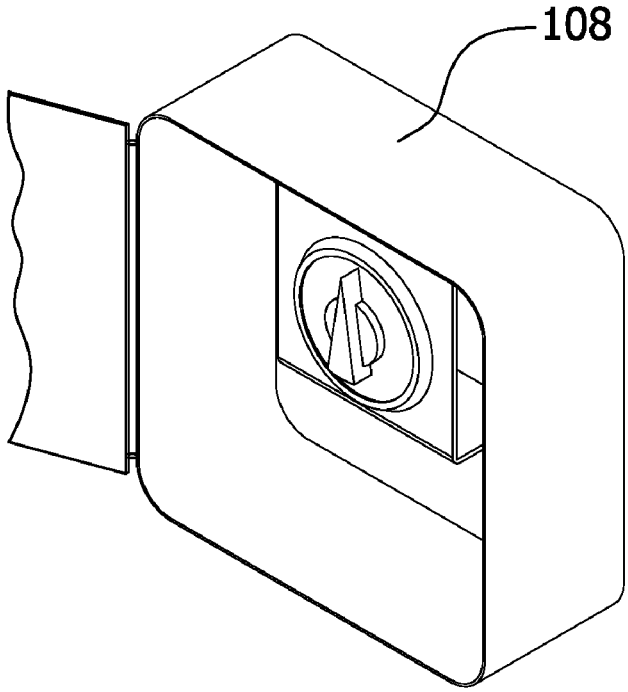
FIG. 16B is an enlarged perspective view of the scrubber system timer located in the housing.

The carbon dioxide absorbing sheets 104 should be replaced after a predetermined interval. To this end, a timer 108 is provided in the chamber 58 that can be set by one of the miners in the chamber (FIGS. 16A and 16B). The timer 108 can be set for a predetermined time after which the absorbing sheets 104 should be replaced. The timer 108 is provided with an alarm that is activated upon the timer running out (i.e., reaching zero) to notify the miners in the chamber 58 that it is time to replace the carbon dioxide absorbing sheets 104. The stiffness of the carbon dioxide absorbing sheets 104 can also serve as an indicator as to when the sheets need to be replaced. The sheets 104 in an unspent condition tend to be pliable but stiffen as the lithium carbonate is formed. Thus, once the sheets 104 become generally stiff they should be replaced with new sheets. The spent sheets 104 can be placed on the floor 20 of the chamber 58 where any remaining lithium hydroxide can be available for absorbing carbon dioxide.

As mentioned above, about 0.5 liters per minute of oxygen are provided for each miner received in the chamber 58. It is estimated that for every 0.5 liters of oxygen inhaled by each of the miners about 0.4 liters of carbon dioxide is exhaled. Thus, for example, about 4 liters of carbon dioxide will be exhaled every minute if 10 miners are received in the chamber. The exhaled carbon dioxide is absorbed by the carbon dioxide absorbing sheets 104 and converted to lithium carbonate, a solid. As a result, the net volume of gas in the chamber 58 is decreased, which would result in the chamber having a negative pressure. To compensate for the loss volume and provide a positive pressure within the chamber 58, in one embodiment the purge cylinders 74 are bled at a constant rate that is greater than the volume of gas being consumed by both the miners and the absorbent sheets 104. Even in the situation where the oxygen masks are being used to provide the miners with breathable air, it would be advantageous to maintain the refuge at a positive pressure to compensate for the oxygen being consumed by the miners.

Figure 17:
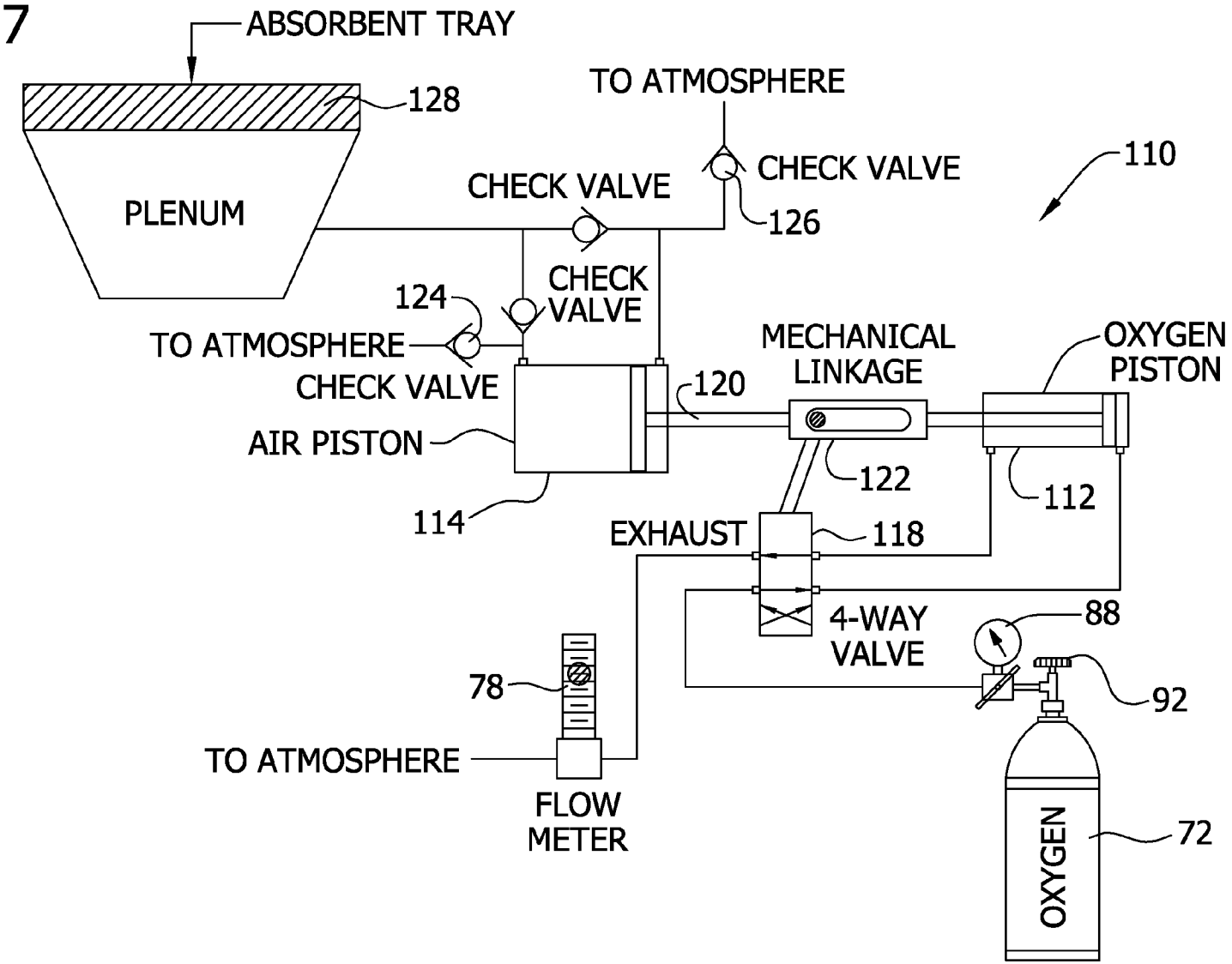
FIGS. 17 and 18 are schematics of a carbon dioxide reduction system that is powered by the oxygen supply system.
Figure 18:
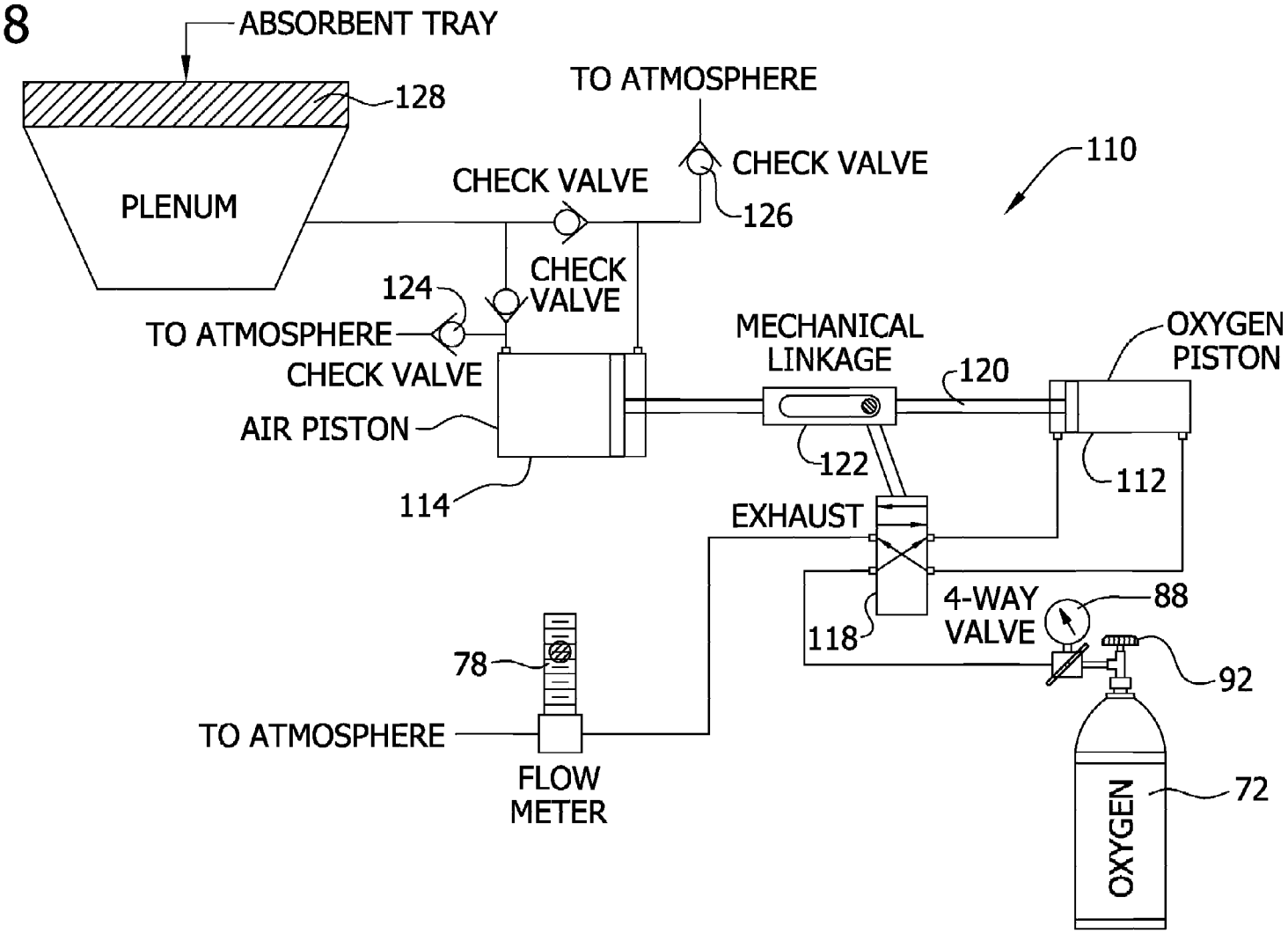
Figure 19:
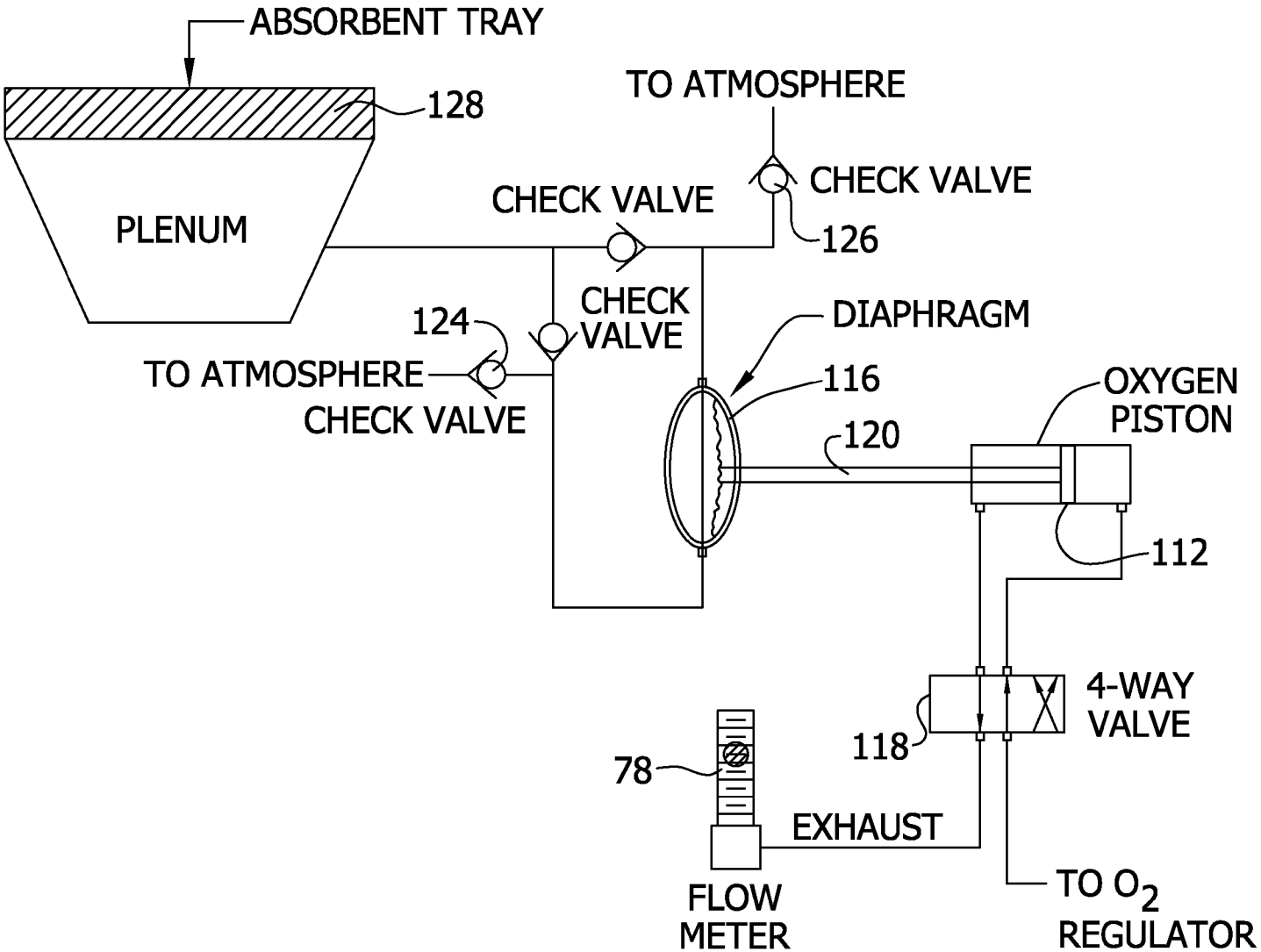
FIG. 19 is a schematic of another embodiment of a carbon dioxide reduction system that is powered by the oxygen supply system.

In other embodiments, the carbon dioxide reduction system 102 includes a calcium-based soda lime, through which air within the chamber must be forced to be treated (FIGS. 17-19). For example, the soda lime includes combinations of hydroxides such as sodium, calcium, and potassium. One such product is commercially available from W. R. Grace of Columbia, Md., U.S.A. under the trademark SODASORB CO2 absorbent. The soda lime can be changed out, as necessary, during use of the chamber 58. Containers (not shown) of soda lime may be sealed in storage and include a mechanism allowing miners to unseal the contents and expose them to air during occupation.

Air, along with the carbon dioxide therein, can be forced through the reduction system 102 in a variety of ways, for example, by a blower 110. The blower 110 may be powered electrically, by oxygen from the oxygen cylinders (e.g., as shown in FIGS. 17-19), or by the miners. If electric power is used, the motor and other components may be contained in an explosion-proof container such as the one illustrated and described with respect to FIG. 21. The container prevents any spark that may occur in or around the motor from igniting potentially flammable gas (e.g., methane) that may be present in the chamber 58.

Alternatively, pressure reduction caused by release of the oxygen may power the blower 110. In one example, the oxygen release powers an air cylinder, diaphragm or turbine (e.g., an oilless turbine). These may include a venturi tube to increase flow through the system. The "scrubbed" air may be directed to miner breathing masks (not shown). In a related example in which the miners wear masks, their exhalation is channeled to the reduction system 102. (The "scrubbed" air from the system may also be channeled back to the mask for inhalation.) Or the scrubbed air may be vented to the chamber atmosphere and the masks adapted to receive the chamber air and force the exhalation to the scrubber.

Examples of oxygen powered blowers 110 or "air pumps" are shown in FIGS. 17-19. An oxygen piston cylinder 112 (the smaller piston cylinder on the right as viewed in the figures) powers an air piston cylinder 114 (the larger piston cylinder on the left as viewed in FIGS. 17 and 18). In another embodiment, the air piston cylinder can be replaced by a diaphragm device 116 (see FIG. 19), or a bellows. Other configurations are contemplated, including without limitation a fan driven by an oxygen powered turbine. Generally, the oxygen piston cylinder 112 is powered by the oxygen being released from the oxygen supply system 70 and operates with the air piston cylinder 114 to pump air through the scrubber bed or "absorbent tray" 128.

More particularly, a device such as a mechanical linkage 122 (shown in FIGS. 17-18) shifts a four way valve 118 at each end of the piston stroke. In the first valve position, an oxygen cylinder rod 120 is extended (FIG. 17). When it reaches the end of its stroke, the valve 118 shifts and the rod 120 begins to retract. At the other end (full retraction, FIG. 18), the linkage 122 causes the valve 118 to shift again to move the rod 120 back. As the rod 120 is forced into the air piston cylinder 114 by the oxygen piston 112, the rod end atmosphere check valve 124 is drawn open by the low pressure in the cylinder and air is induced into the rod side of the piston. Simultaneously, the rod side chamber discharge valve is forced closed by the relatively greater pressure in the refuge chamber 58. Also, a blind end chamber check valve 126 is forced open and the air in the blind end of the air piston cylinder 114 is being forced into the chamber 58, and the blind end atmospheric valve is closed to prevent the cylinder air from going back to the atmosphere. This all reverses when the rod 120 is pulled from the cylinder. As can be seen, this design is double acting, meaning that every stroke from the flow of oxygen causes air to be pumped into the chamber 58.

As indicated above, the oxygen flow is generally determined by the number of miners received in the chamber. Thus, the power available for the blower 110 or "air pump" is, by default, also determined by the number of miners. As the oxygen requirement increases, the pump runs faster and pumps more air through the carbon dioxide scrubber bed (the absorbent tray 128 as shown). In another embodiment or as a failsafe for the above, a hand crank or bellows (e.g., accordion-style) can be provided so that the miners within the chamber 58 can power the blower.

It is also contemplated that a sufficient number of purge cylinders 74 can be provided to eliminate the carbon dioxide reduction system 102 from the chamber 58. In this embodiment, the purge cylinders 74 are used to generate a positive pressure within the chamber 58 and generate sufficient air movement within the chamber so that the carbon dioxide is evacuated from the chamber through the vent 98. Moreover, if the mine M has mine air lines running in the area in which the refuge 10 is placed, the mine air line can be connected to the refuge for supplying breathable air to the chamber 58. The mine air can supplement the purge cylinders 74 and/or the oxygen cylinders 72.

The oxygen supply system 70 and carbon dioxide reduction systems 102 can be adapted to provide breathable air and/or a suitable chamber environment for more than at least about 48 hours, preferably, more than at least about 75 hours, and most preferably more than at least about 100 hours depending on the application.

Embodiments of the chamber 58 are adapted to provide breathable air and/or suitable environment with no power. The chamber 58 can perform without any outside air supply, water, or electrical power, and the chamber can also run without battery or other electrical power. In other words, no power, battery or otherwise, is required to run the chamber 58. In the illustrated embodiment, the refuge 10 does include a permissible, thru-hull telephone 130 for connecting to the mine's telecommunication system, if available.

It is contemplated to mount a workbench or cabinets (not shown) on the outside of the refuge 10, e.g., on the back wall 16. It is also contemplated that the chamber 58 can function as an underground office.

The refuge 10 can be used by miners in the event of a mine emergency who are unable to safely exit the mine M. In use, the miners open the door 24 to the refuge 10 using the handle 30 thereby rupturing the tamperproof seal 46 and providing access to the chamber 58 of the refuge. After the miners have entered the chamber 58 and shut the door 24, the chamber 58 can be purged of any potential harmful mine air by opening one or more of the purge cylinders 74. The purge cylinder 74 provides breathable air that is rapidly released to quickly and effectively provide breathable air to the chamber 58 while forcing potentially harmful mine air out of the chamber through the vent 98. The muffler 84 will dampen the noise of rapidly releasing the breathable air from the purge cylinder 74. Once the chamber 58 has been purged, the miners should adjust the flow rate from the purge cylinders 74 using the purge air selector 96 to provide and maintain a positive pressure within the chamber.

Using the oxygen selector 92, the miners start and adjust the rate at which is oxygen is supplied to the chamber 58 by the oxygen cylinders 72. The oxygen flow rate is set to a predetermined rate based on the number of miners in the chamber 58. Typically, the flow of oxygen from the oxygen cylinders 72 is set to about 0.5 LPM per miner. The miners can increase or decrease the oxygen flow rate using the selector 92 if miners enter or leave the chamber during its use.

The miners also need to activate the carbon dioxide reduction system 102. In one embodiment, the miners remove a predetermined number of the absorbing sheets 104 stored under the seats 60, open them, and hang them from the rods 106 provided above the seats. The miners can set the timer 108, which will sound an alarm, to notify the miners to replace the absorbing sheets 104. In addition to or instead of setting the timer 108, the miners can periodically feel the absorbing sheets 104 to determine if they have become stiff. Once the absorbing sheets 104 become stiff, the miners should replace them.

Once the oxygen supply system 70 and carbon dioxide reduction system 102 are in operation, no additional input is needed by the miners until the absorbing sheets 104 of the carbon dioxide reduction system need to be replaced, which is typically hours. In addition, depending on the severity of the event that resulted in the miners taking cover in the refuge 10, the miners may be trapped in the mine and thus the chamber 58 for a substantial period of time. As a result, the chamber 58 is provided with a sufficient number of seats 60 for each of the miners to sit down and rest. In addition, some of the miners can even lie down and sleep, e.g., on the floor 20 between the row of seats 60.

Moreover, essential items are provided in the chamber 58 to sustain the miners for a substantial period of time (e.g., 100 hours). These items include, but are not limited to, food, water, flashlights (e.g., 300 hour permissible flashlights), a toilet, a first aid kit, splints, backboard, and refuge repair materials (e.g., acrylic windows, duct tape). Other items for helping the miners pass the time and divert their attention are also provided in the chamber 58. For example, the storage containers 62 can include reading materials (e.g., books, magazines), pencils, paper, games, playing cards and the like. As a result, the miners can remain inside the chamber 58 for a substantially long period of time (e.g., 100 hours or more). The miners should remain in the chamber 58 until they are rescued or can otherwise safely exit the mine M.

Figure 20:
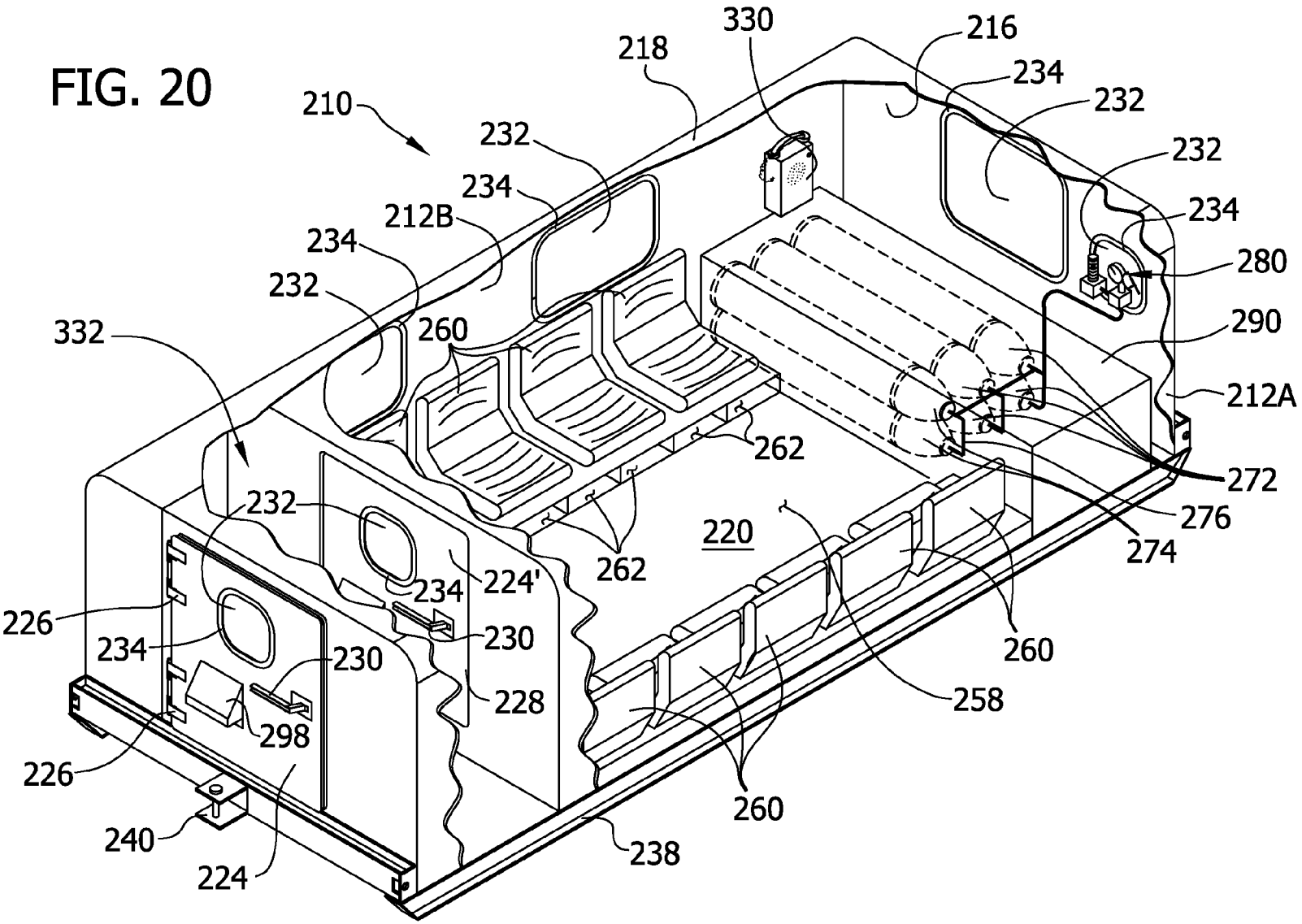
FIG. 20 is a perspective view of another embodiment of a mine refuge having an airlock.

FIG. 20 illustrates another embodiment of a mine refuge 210 defining an interior chamber 258 similar to the mine refuge 10 illustrated in FIGS. 1-19 but including an airlock 332 extending forward from a front wall 214 and an oxygen supply system 270 being located adjacent to a back wall 216. The airlock 332 may be advantageous because the miners may not all enter the refuge 210 at the same time. The airlock 332 reduces the adverse effect on the chamber environment when more miners enter the chamber 258. A mechanism (i.e., a vent 298), such as an automatic mechanism, may be included for purging the air in the airlock 332. With such mechanism, the miner entering would enter the airlock 332, close an outside door 224, and then purge the air from the airlock prior to opening an inside door 224' and entering the interior chamber 258 of the refuge 210. This could include forming the doors 224, 224' so as to allow significant leakage around the doors. The leakage would allow air flow through the inside door 224', through the airlock 332, and out the outside door 224 to thereby purge the airlock after some period of time. That period of time may depend on how much oxygen or clean air is being introduced into the chamber 258, which causes the chamber to be under positive pressure and forces air out around the doors 224, 224'. Other mechanisms, such as one-way valves, are contemplated. It is noted that the interior door 224' swings inward into the mine refuge 210 whereas the exterior door 224 swings outward away from the mine refuge. Parts corresponding to those in FIGS. 1-19 are indicated by the same reference numbers plus "200".

Figure 21:
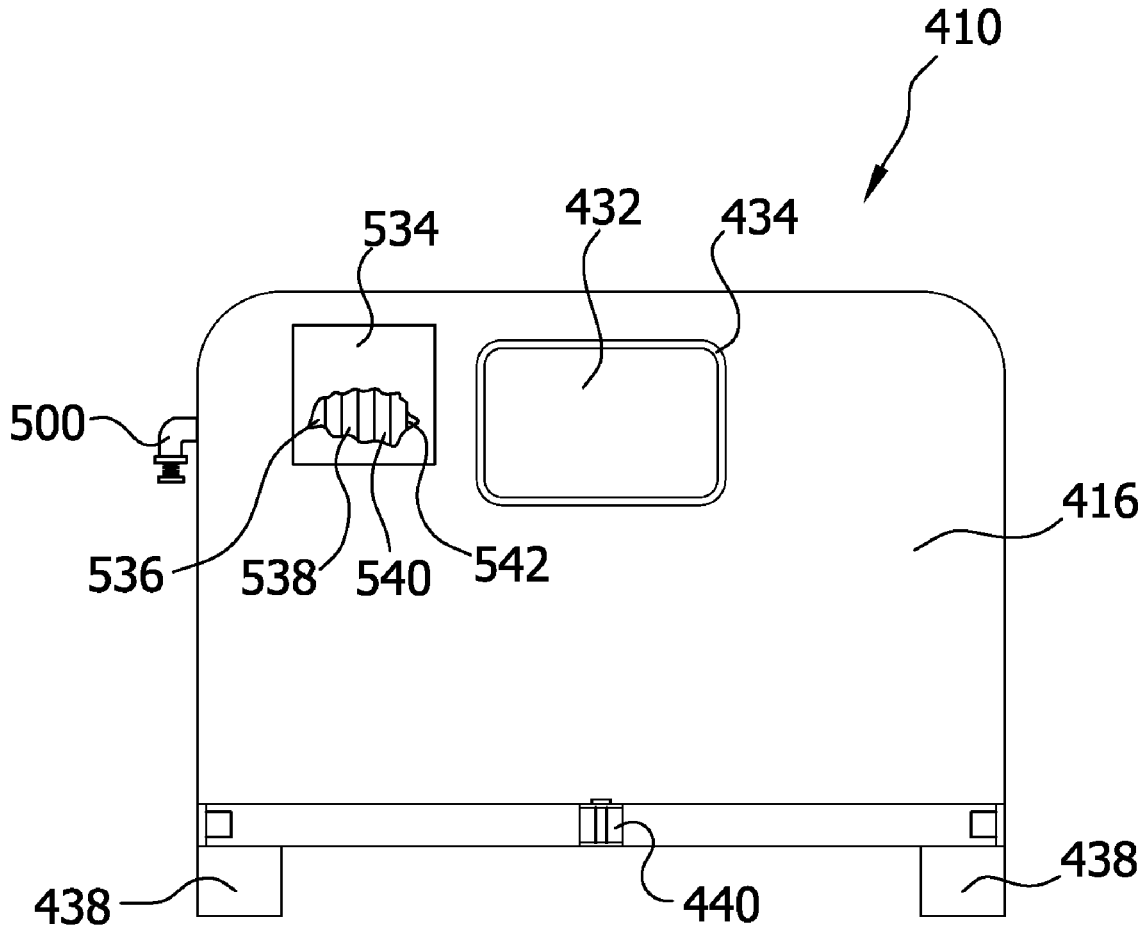
FIG. 21 is an elevation view of a back wall of a refuge of another embodiment having an explosion proof container.

In another embodiment as illustrated in FIG. 21, a refuge 410 can include an explosion proof box 534 mounted to an exterior of the refuge, e.g., a back wall 416 of the refuge. The explosion proof box 534 allows otherwise non-permissible items to be placed safely in the mine M. In the illustrated embodiment, the explosion proof box 534 includes an air conditioning unit 536, an inverter 538, and a battery 540 for supplying power to the air conditioning unit. It is understood that the explosion proof box 534 can contain electrical items other than those disclosed herein.

The air conditioning unit 536 can be selectively activated, such as by an on/off switch (not shown), by the miners in the chamber 458 of the refuge 410 to cool the chamber. The air conditioning unit 536 can be operatively connected to a methanometer 542 so that if the methane level in the chamber 458 reaches a predetermined level (e.g., 1%) the air conditioning unit could not be activated and, if activated, would shut off. Upon the methane level falling below the predetermined level, the air conditioning unit 536 can be activated to cool the chamber. It is contemplated that the methanometer 542 can be separate from the air conditioning unit 536, for example, a handheld methanometer. Instructions not to operate the air condition unit 536 if the methane level within the chamber 458 is above or raises above the predetermined level can also be provided in the chamber.

The air conditioning unit 536 is preferably designed to cool and circulate air within the chamber 458. In other words, the air conditioning unit 536 does not draw mine air into the chamber 458. As a result, a door 424 to the chamber 458 should remain shut during operation of the air conditioning unit 536 to prevent mine air from being drawn into the chamber by the air conditioning unit. Instructions not to operate the air conditioning unit 536 with the door 424 to the chamber 458 open can be provided. In another embodiment, the air conditioning unit 536 is operatively connected to the door 424 so that when the door is opened, the air conditioning unit is automatically shut off. The air conditioning unit 536 can either be automatically restarted or manually restarted upon closing of the door 424. Parts corresponding to those in FIGS. 1-19 are indicated by the same reference numbers plus "400".

Figure 22:
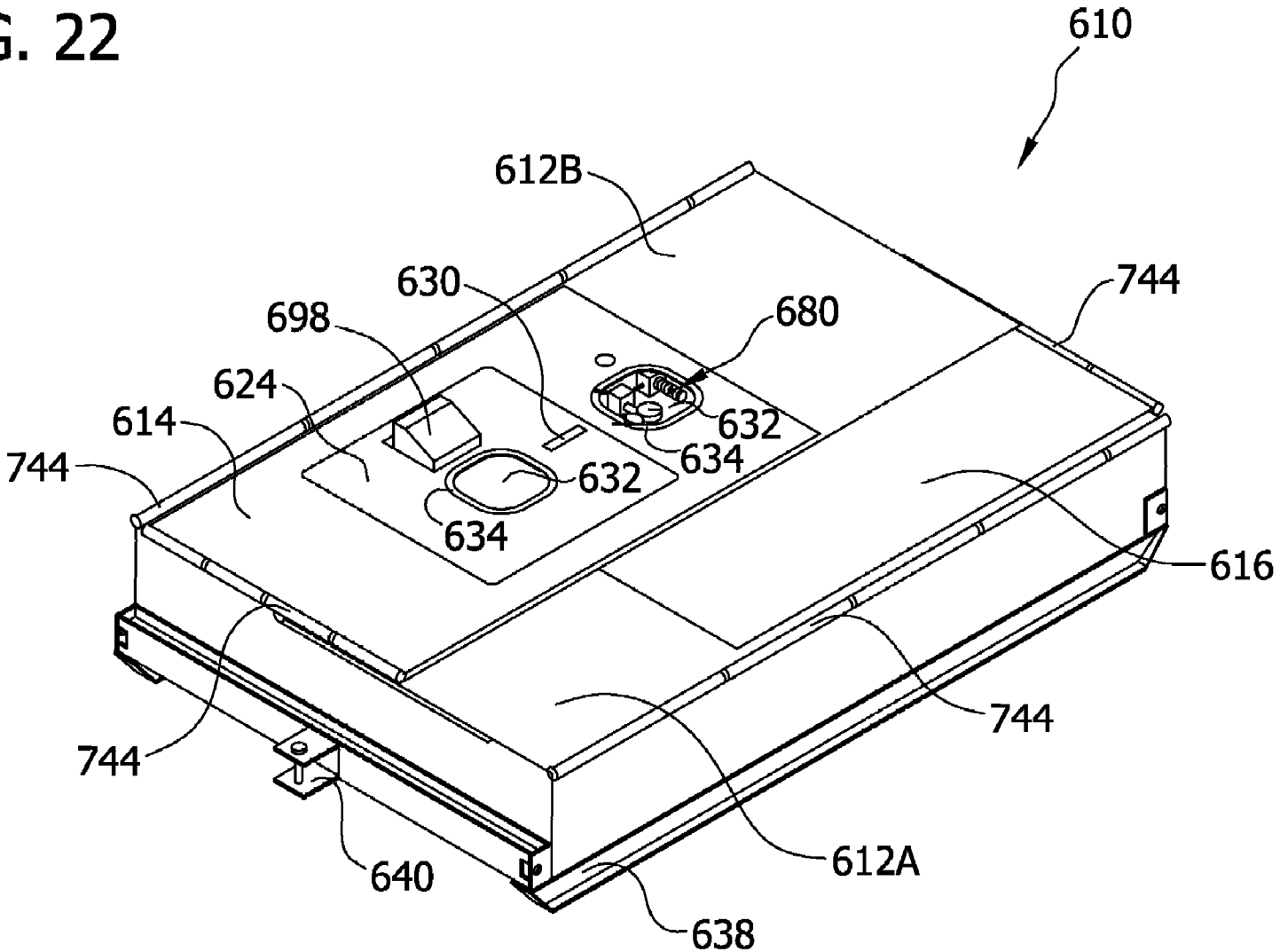
FIG. 22 is a perspective view of a collapsible embodiment of a mine refuge being in a collapsed condition.
Figure 23:
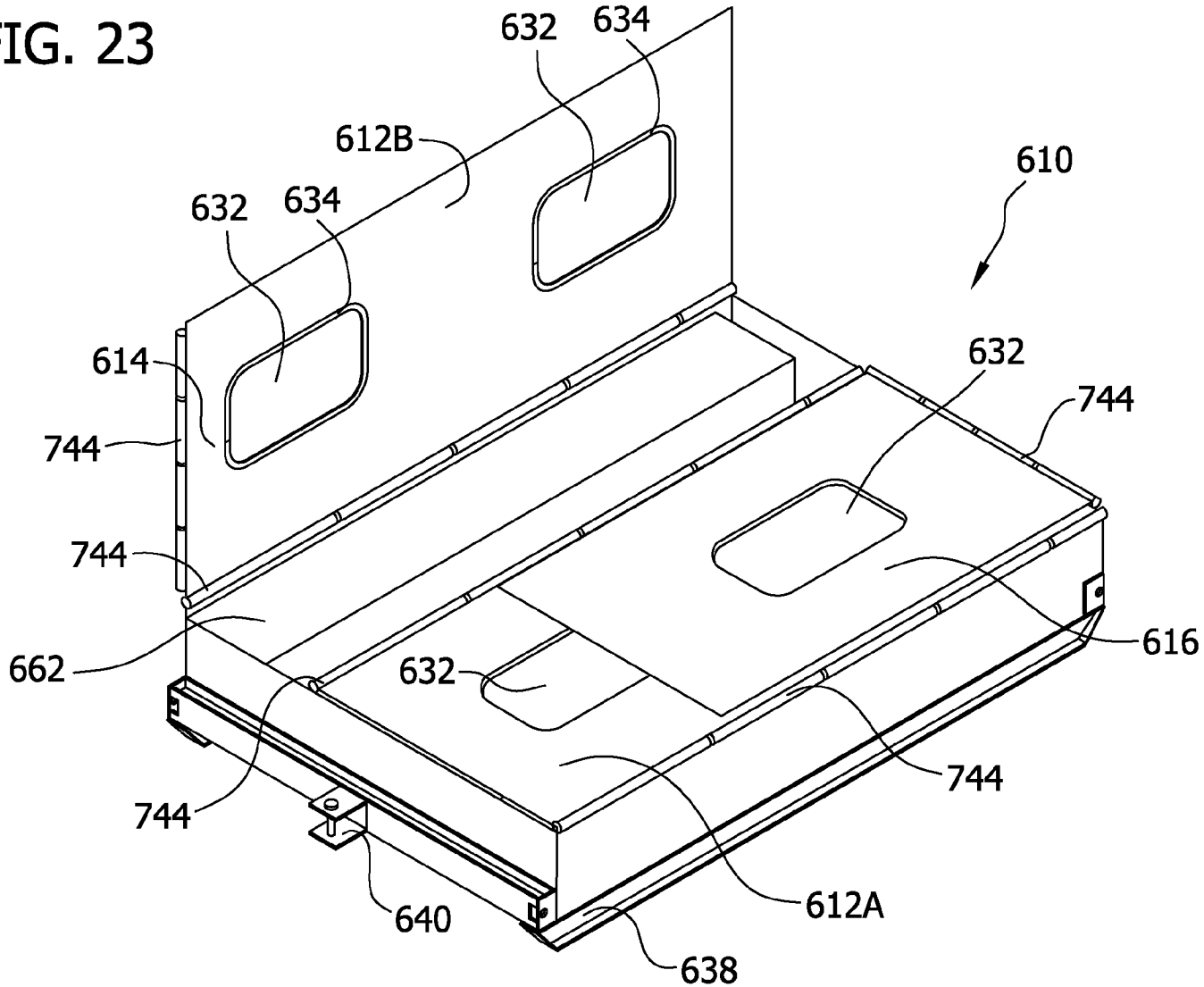
FIG. 23 is a perspective view similar to FIG. 15 but showing one side wall of the collapsible mine refuge erected.
Figure 24:
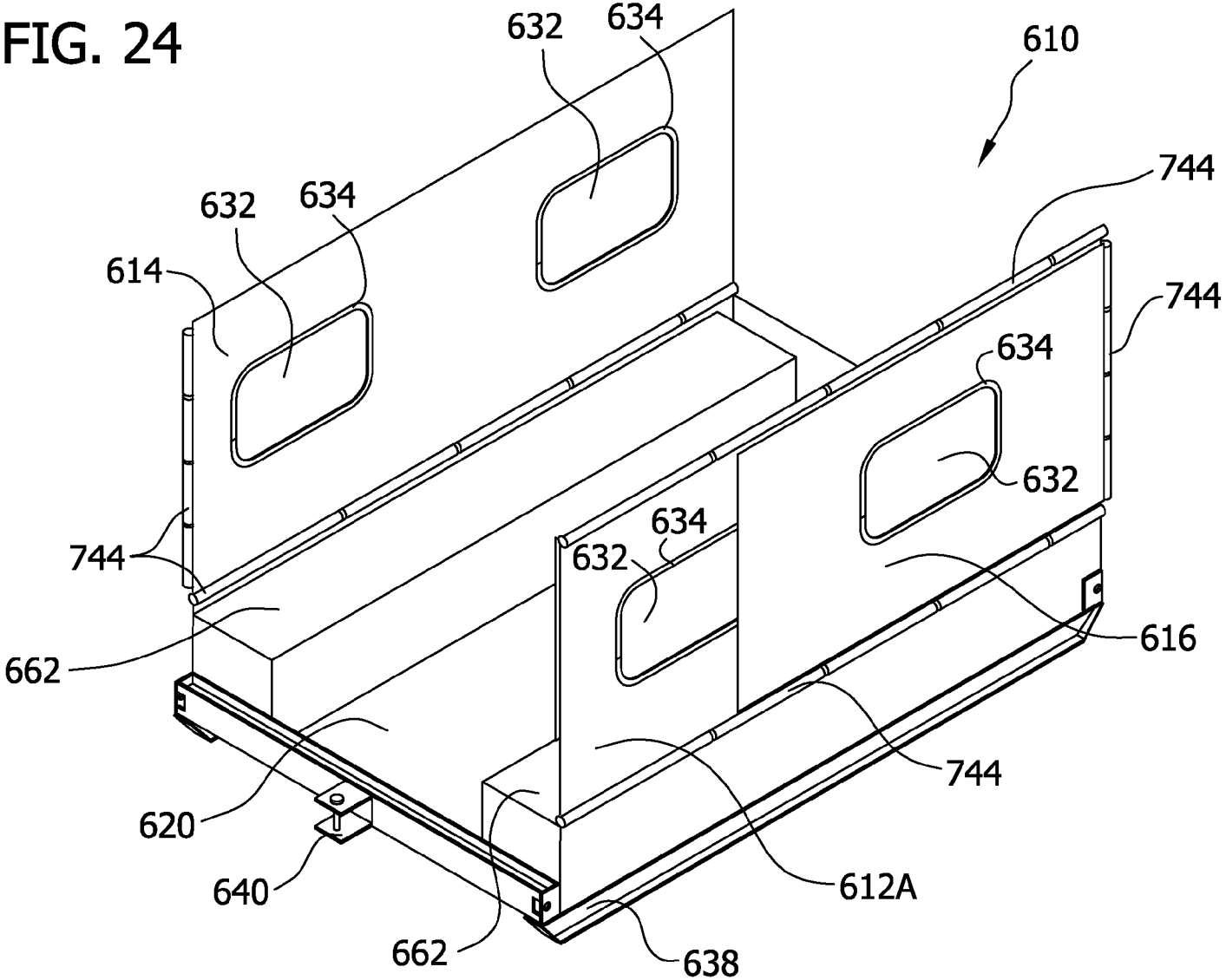
FIG. 24 is a perspective of the collapsible mine refuge with two side walls erected.
Figure 25:
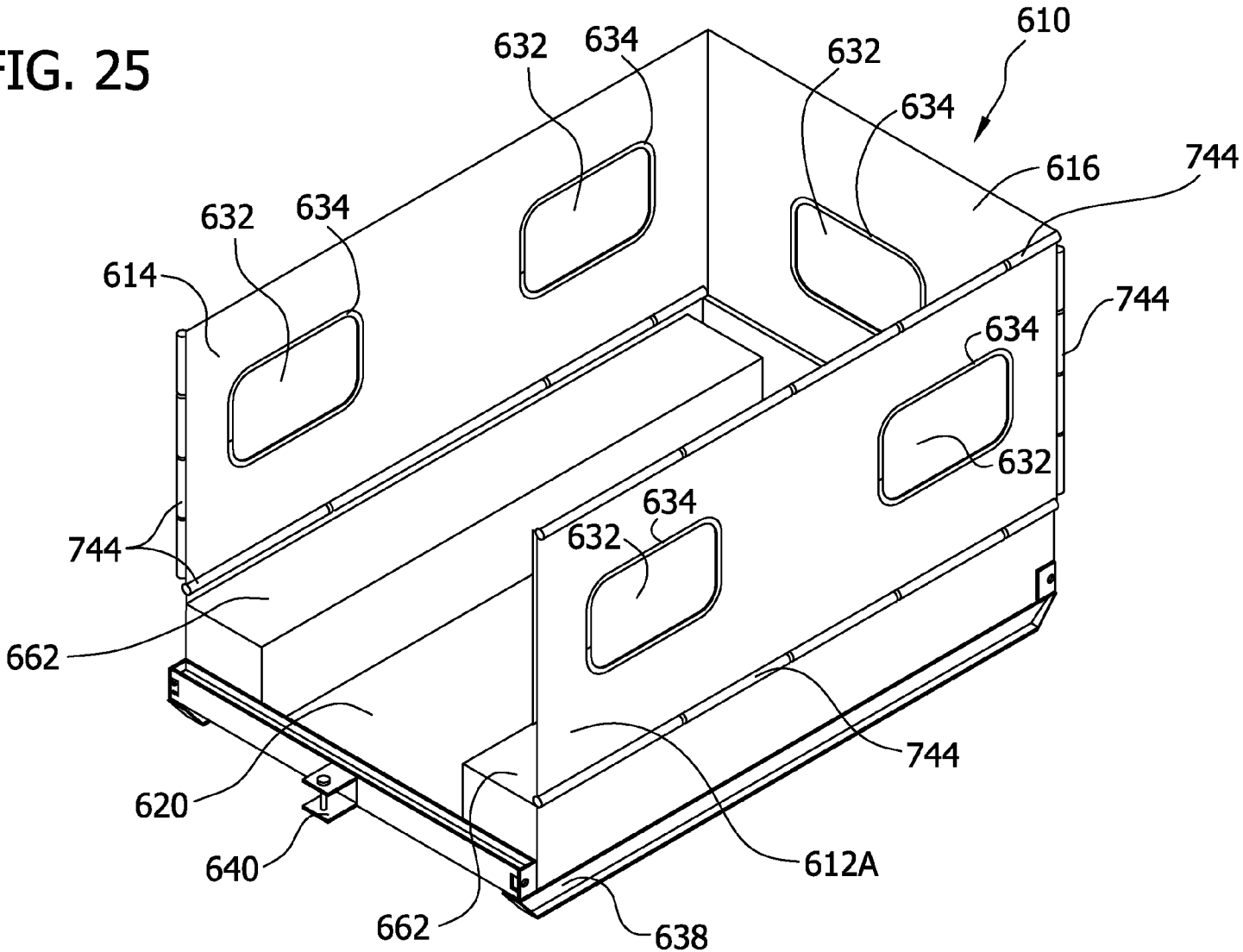
FIG. 25 is a perspective view of the collapsible mine refuge with the two side walls and an end wall erected.
Figure 26:
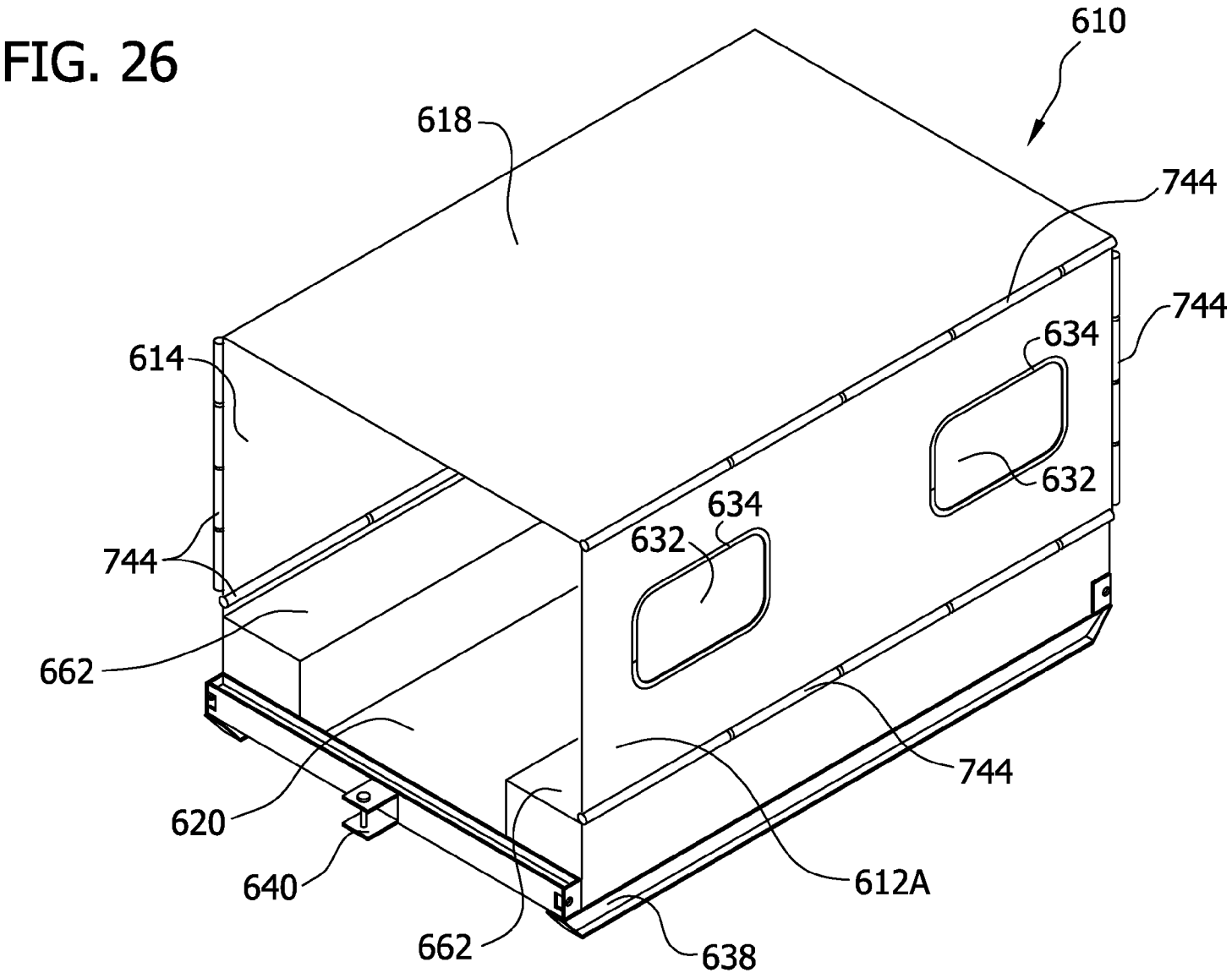
FIG. 26 is a perspective view of the collapsible mine refuge with the two side walls, the end wall, and a roof of the mine refuge erected.
Figure 27:
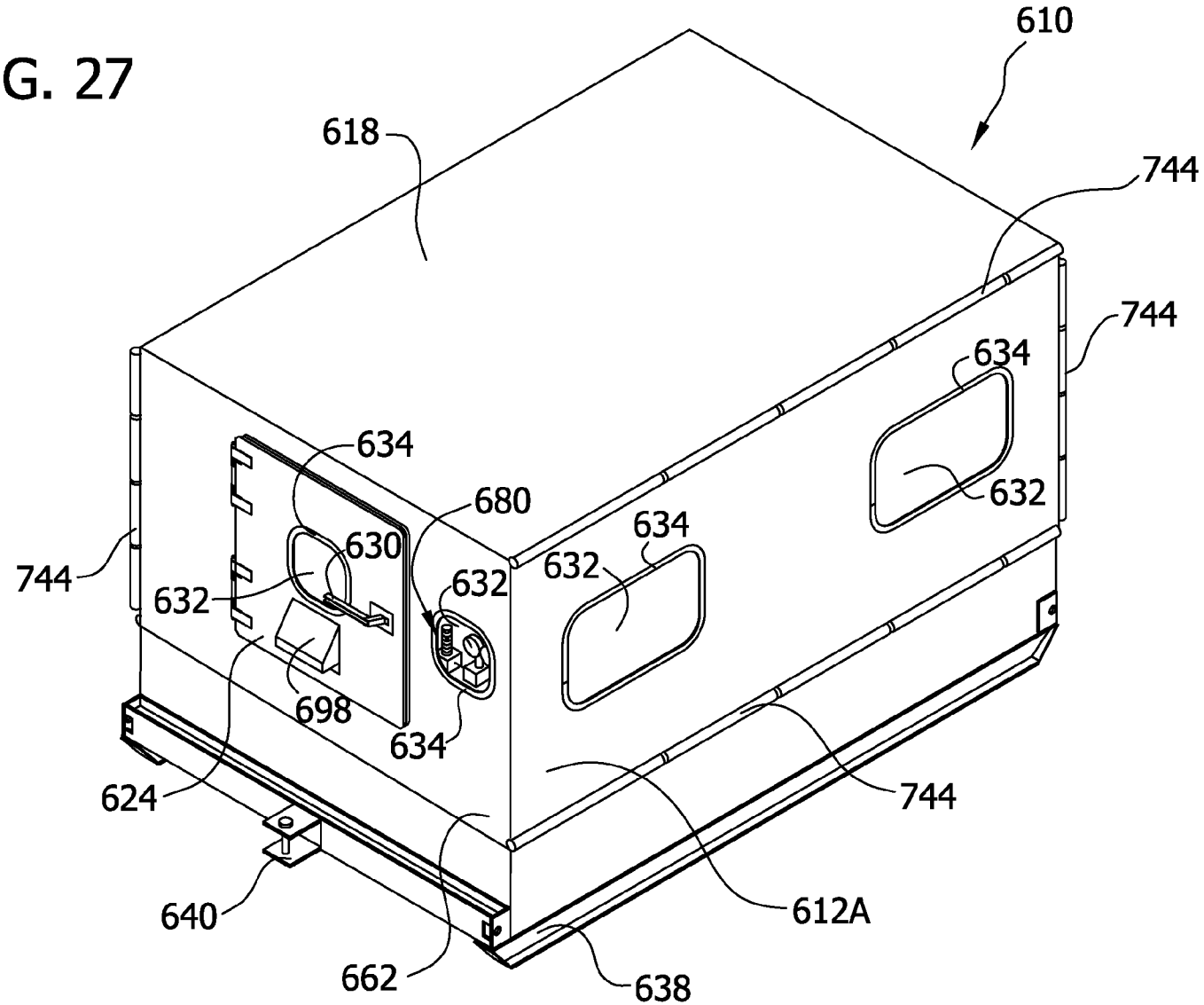
FIG. 27 is a perspective view of the collapsible mine refuge in an erected condition.

In an embodiment shown in FIGS. 22-27, a refuge 610 is adapted for constructed in the mine M, rather than being pre-manufactured as in FIGS. 1-19. A "skid" or base 638 includes all or most of the components of the refuge 610 (FIG. 22). Walls 612A, 612B, 614, 616 and a roof member 618 are all hinged together so that there are no loose walls or roof members. To construct the refuge 610, a right side wall 612A is rotated upward about its hinge 744 to a generally vertical orientation (FIG. 23) and an opposite left side wall member 612B is likewise rotated upward (FIG. 24). A back wall 616, hinged to the left wall 612B, is rotated into position in FIG. 25. The roof member 618 is hinged to the left side wall 612B, and as shown in FIG. 26, is rotated into generally horizontal orientation. A front wall 614 is hinged to the right side wall 612A and is rotated into its vertical orientation as shown in FIG. 27.

The joints/hinges 744 between the various wall members 612A, 612B, 614, 616 and roof members 618 may be sealed by suitable means. As one example, each joint includes a flange turned outward that contacts a gasket (e.g., a rubber seal similar to a "man door" rubber seal) on a matching flange. It is also contemplated to have no seal and let the joints serve as relief valves.

The hinges 744 may be "piano-type" hinges as shown, but many other types of hinges and joints are contemplated. The completed refuge 610 is shown in FIG. 27, and optionally includes any or all of the components described above, including seats 660, provisions, an oxygen supply system 670, and a carbon dioxide reduction system 702. Note the various components may be made more compact, e.g., the seat backs may be folded down when the refuge is in the collapsed position of FIG. 22.

Other configurations are contemplated, including those where there are loose wall or roof members (i.e., not hingely connected). It is also contemplated to use the roof member as a "skid" or base. Parts corresponding to those in FIGS. 1-19 are indicated by the same reference numbers plus "600".

Figure 28:
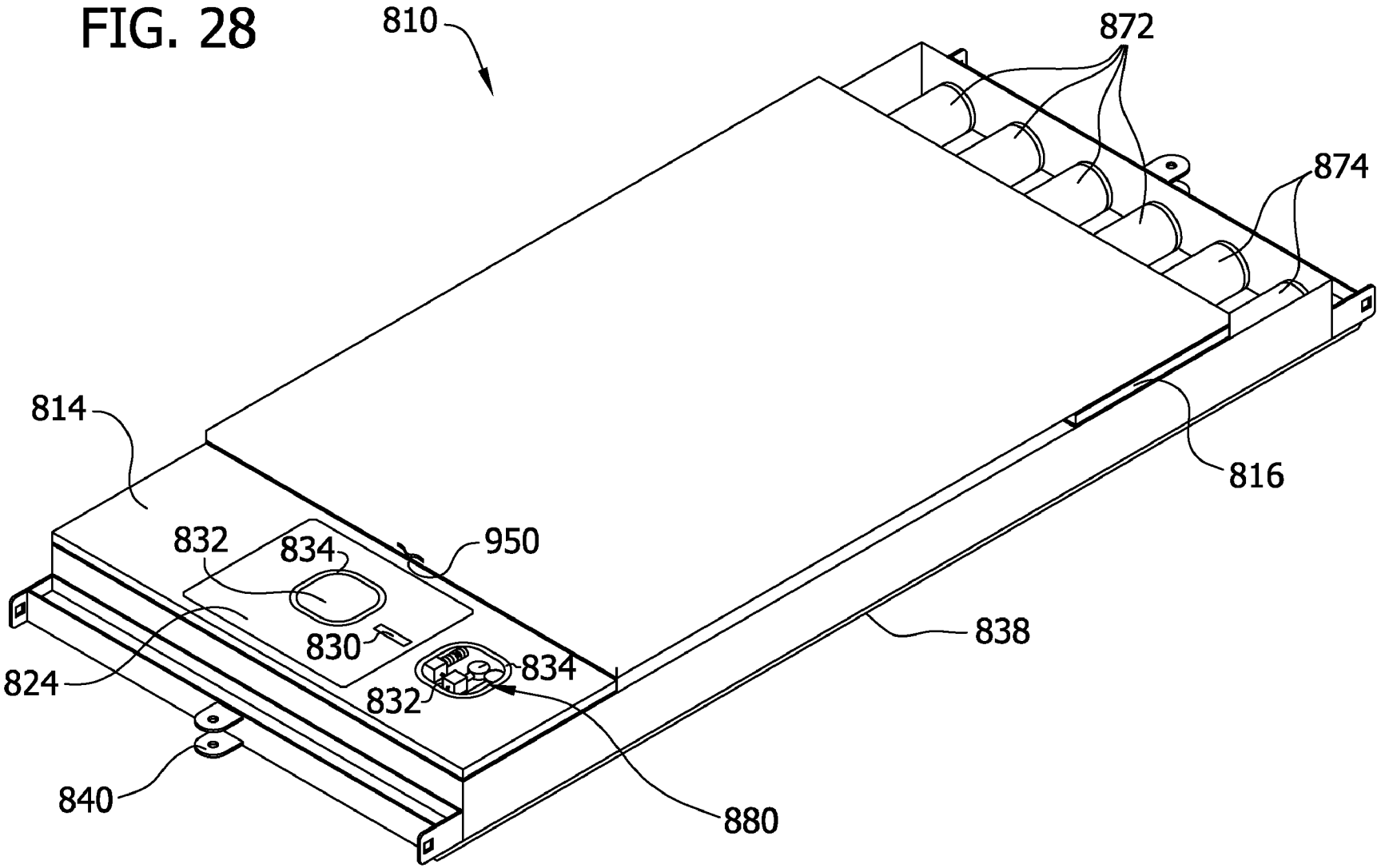
FIG. 28 is a perspective view of another embodiment of a collapsible mine refuge in a collapsed position.
Figure 29:
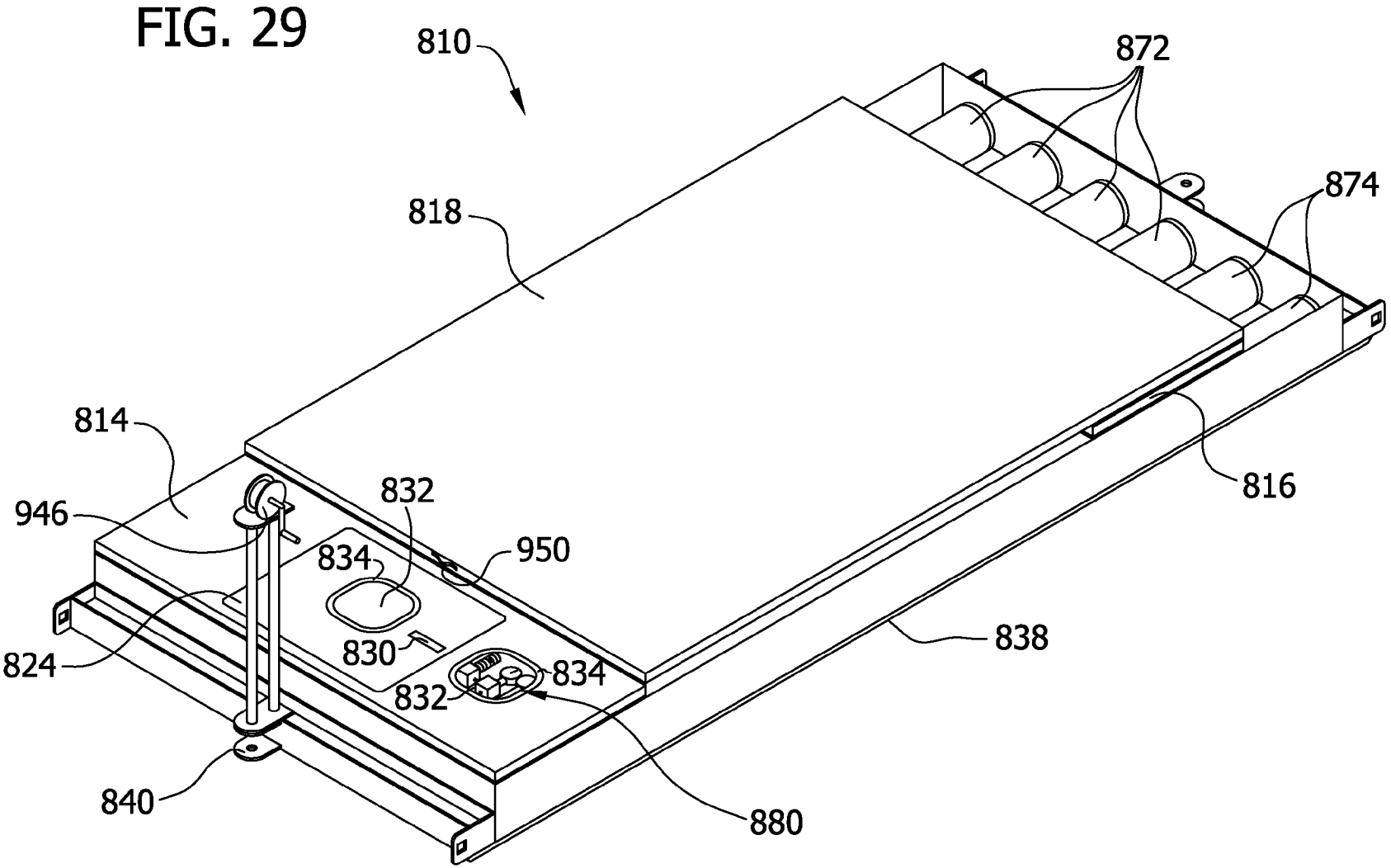
FIG. 29 is a perspective view of the collapsible mine refuge having a hand crank attached for raising the mine refuge.
Figure 30:
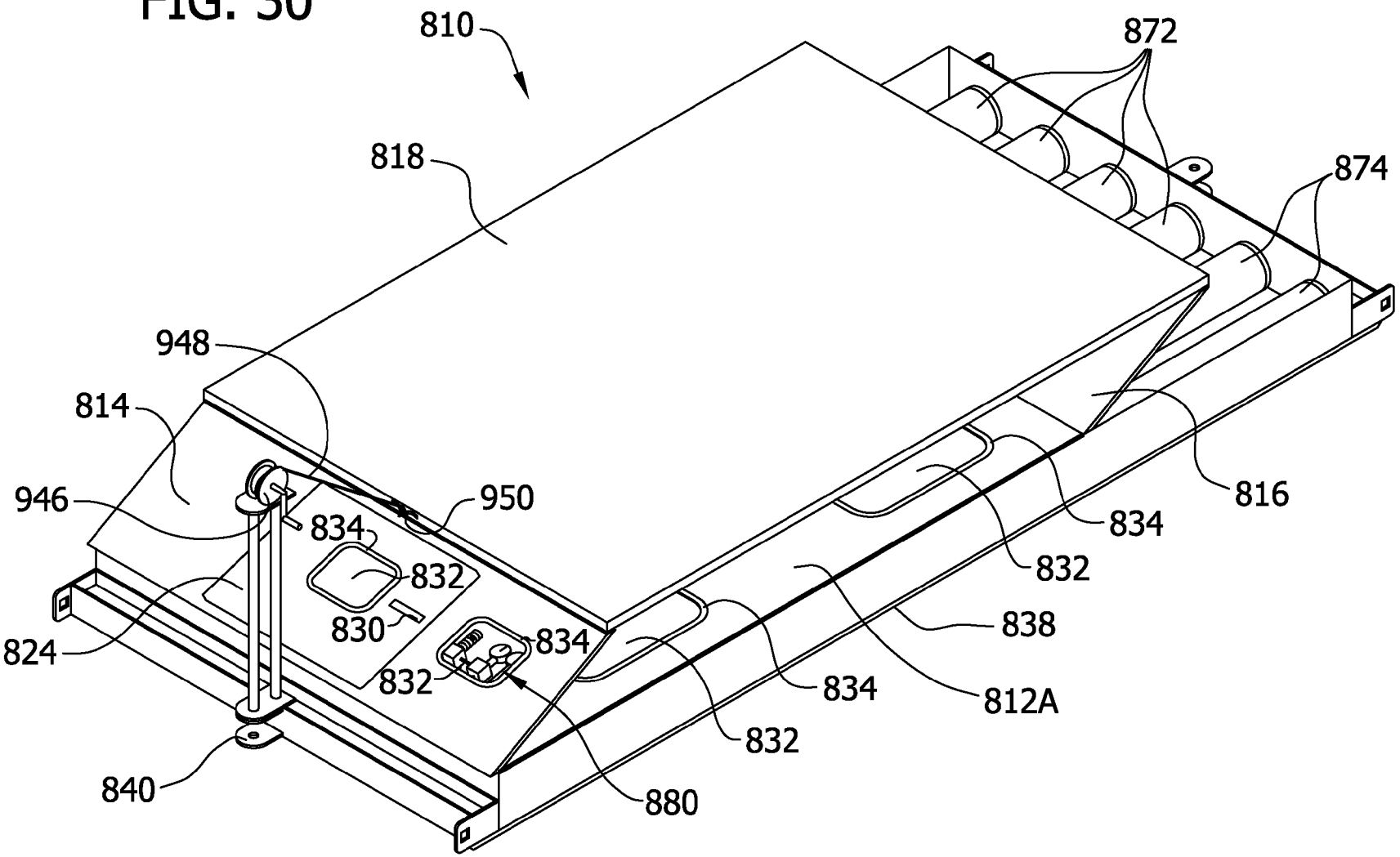
FIG. 30 is a perspective view of the refuge of FIG. 29 showing the hand crank being used to raise the collapsed mine refuge.
Figure 31:
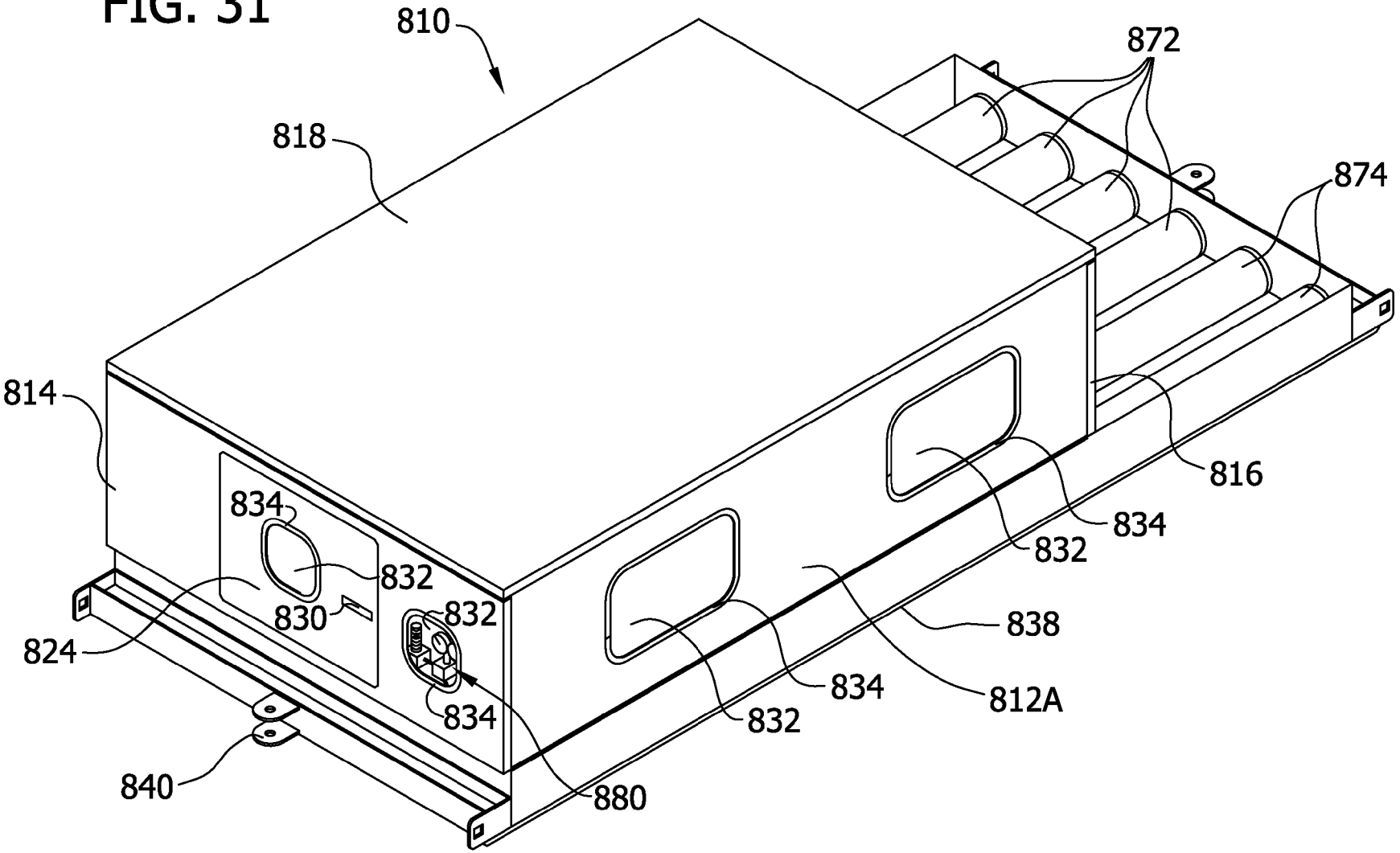
FIG. 31 is a perspective view of the collapsible mine refuge in an erected position.

FIGS. 28-31 illustrate another embodiment of a refuge 810 adapted for construction in the mine M. A "skid" or base 838 includes all or most of the components of the refuge 810 in a collapsed position (FIG. 28). In this embodiment, a hand crank 946 is adapted for connection to a hitch 840 adjacent a front wall 814 of the refuge 810 and for raising the refuge from the collapsed position. A cable 948 or the like can be attached to the hand crank 946 and a hook 950 on the refuge 810. As the hand crank 946 is turned, the refuge 810 is raised from the collapsed position to an erected position (see FIGS. 30 and 31). One or more prop rods (not shown) can be used to secure the refuge 810 in the erected position and prevent the refuge from being collapsed. Parts corresponding to those in FIGS. 1-19 are indicated by the same reference numbers plus "800".

Figure 32:
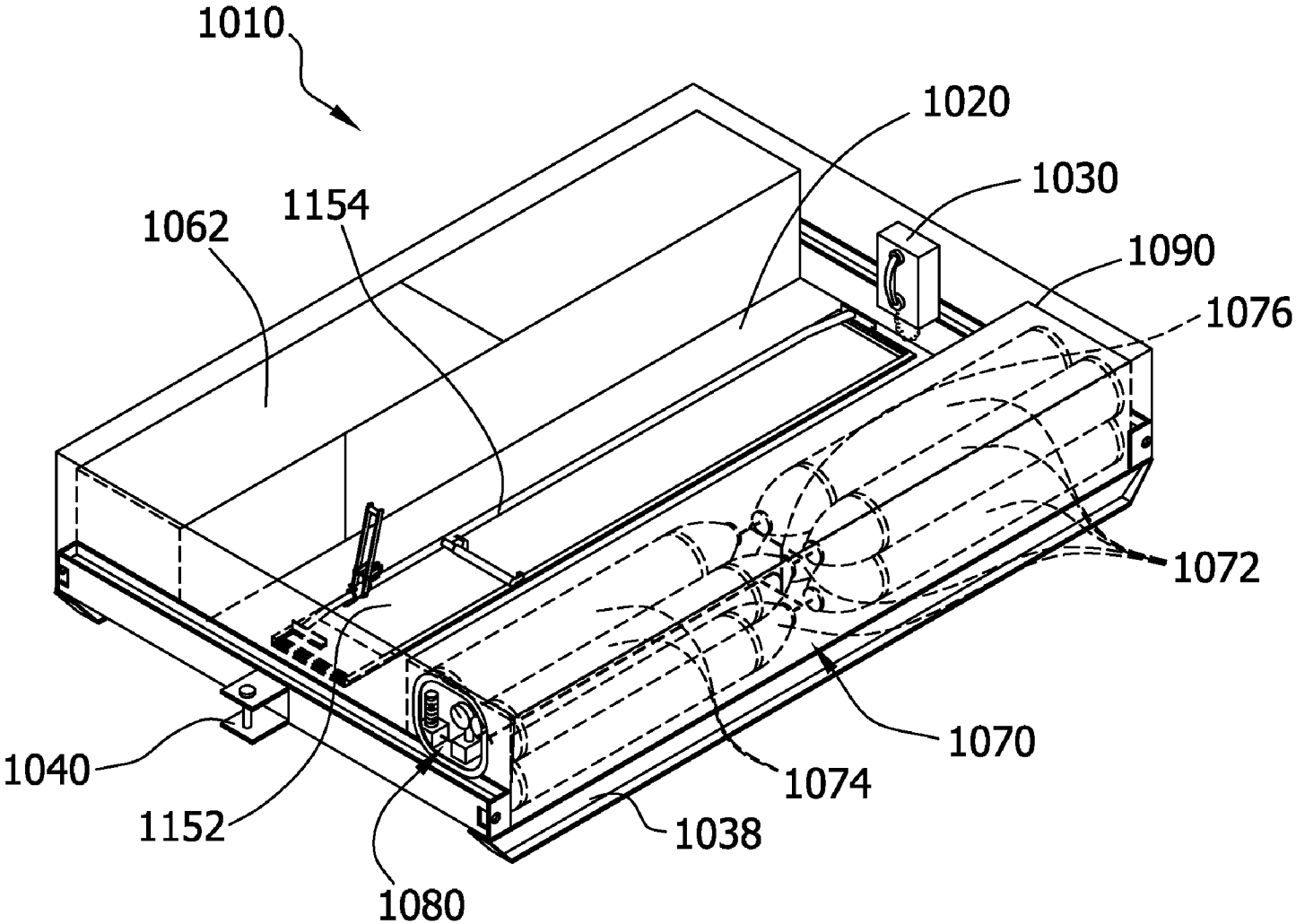
FIG. 32 is a perspective view of a skid containing materials for erecting a mine refuge.
Figure 33:
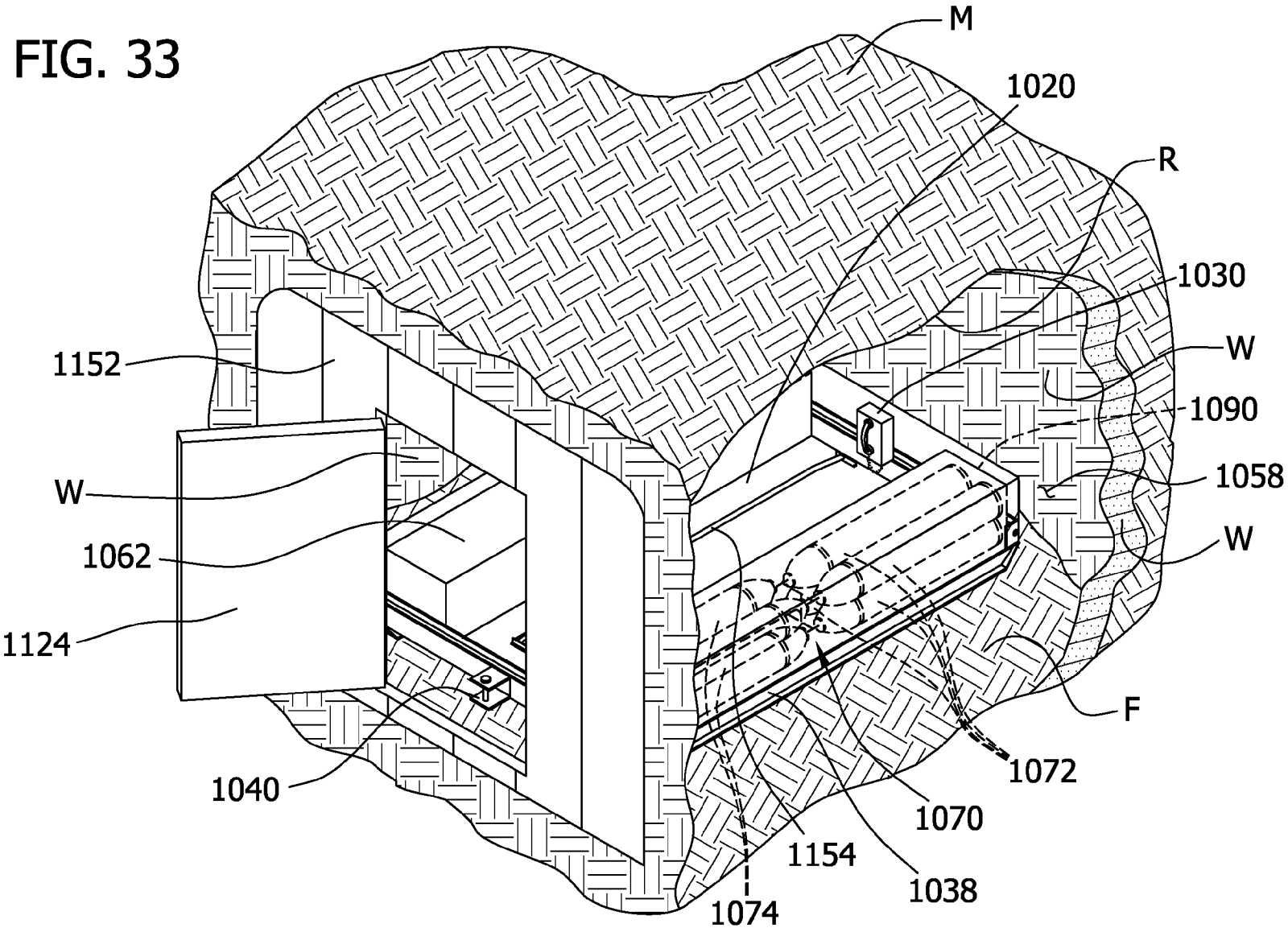
FIG. 33 is a perspective view of a chamber formed by sealing off a portion of a mine, parts of the mine are cut away to expose the chamber.

In another embodiment shown in FIGS. 32 and 33, a skid or base 1038 includes an oxygen supply system 1070, a carbon dioxide reduction system 1102, and/or provisions as described above, in combination with "Kennedy stopping" building materials. Such materials may include panels 1152, a jack 1154, sealants, headers, footers, and other materials. The panels 1152 and jack 1154 are illustrated on the skid 1038 in FIG. 32. Suitable materials are described in U.S. Pat. Nos. 2,729,064, 4,483,642 (reissued as U.S. Pat. No. 32,675), U.S. Pat. No. 4,547,094 (reissued as Re. 32,871), U.S. Pat. Nos. 4,695,035, 4,820,081, 5,167,474, 5,412,916, 5,466,187, 6,220,785 and 6,264,549, and U.S. application Ser. No. 10/951,116 (overlapping panels), all of which are incorporated herein by reference in their entireties. It is understood that other type of stopping materials (e.g., concrete blocks, brattice cloth) can be used in combination with the skid 1038.

As shown in FIG. 33, the panels 1152 can be used to section off a portion of the mine M to form a chamber 1058. In the illustrated embodiment, the panels 1152 extend vertically from a floor F of the mine M to a roof R of the mine, and horizontally between the mine side walls W. The panels 1152 cooperate with the walls W, roof R, and floor F of the mine to define the chamber 1058. In the illustrated embodiment, only one of the chamber 1058 walls is formed using the panels 1152 but it is to be understood that the panels 1152 can be used to form additional walls, including all four walls. The erected panels 1152 include a door 1156 for allowing miners to enter and exit the chamber 1058.

The panels 1152 can extend upward from the skid 1038 instead of from a floor F of the mine M. Tops of the panels 1152 may extend to or into a roof R of the mine M, though an intermediate member (i.e., a roof member) may also be used. The joints between panels 1152 and between the panels and the mine may be sealed as described in any of the listed patents, or as described in U.S. Pat. No. 6,419,324, which is also incorporated herein in its entirety by reference. It is also contemplated that the panels may be formed as pre-connected sections, similar to that described in U.S. Pat. No. 6,688,813, which is also incorporated herein in its entirety by reference. It is also contemplated to use an overcast, or portions thereof. An overcast is shown in the '549 patent, among others. It is also contemplated to use the materials in combination with excavated portions of the mine, e.g., by building the chamber into a hole or "manhole" dug into the rib or floor of the mine for refuge. Parts corresponding to those in FIGS. 1-19 are indicated by the same reference numbers plus "1000".

This embodiment and the other embodiments that are adapted for construction inside the mine (the embodiments shown in FIGS. 22-33 may be especially useful for mines with smaller passageways, e.g., "low coal" mines where movement of a taller refuge would be problematic. It is contemplated that these refuges can be constructed at a location outside of the mine and transported into the mine. It is also contemplated that the refuges can be constructed before or after an event occurs which warrants the use of the refuge. It is preferred, however, to have the refuges constructed beforehand and thus ready for use in the event of a mine emergency.

Figure 34:
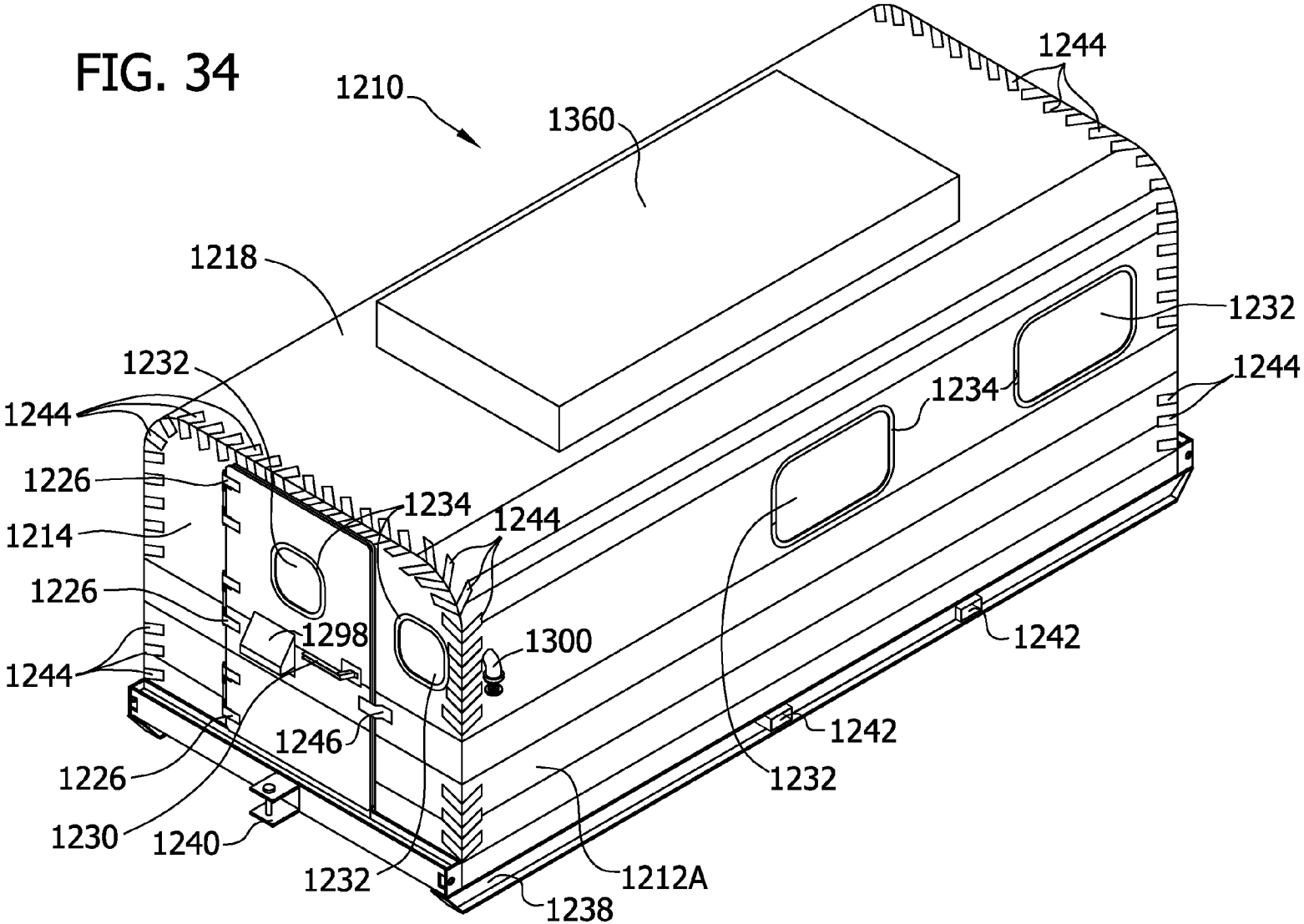
FIG. 34 is a perspective view of still another embodiment of a refuge having a cooling water tank.

FIG. 34 shows a mine refuge 1210 of yet another embodiment including a supply of cooling water stored in a water tank 1360 that can be used to cool the refuge 1210. In the illustrated embodiment, the water tank 1360 is disposed on a roof 1218 of the refuge 1210. As a result, gravity can be used to distribute or "trickle" water over the outside of the refuge

1210. The outside of the refuge 1210 may be covered by cloth, sponge or the like to wick the water around the refuge. Parts corresponding to those in FIGS. 1-19 are indicated by the same reference numbers plus "1200".

The various refuge embodiments described herein can be made sufficiently robust to withstand rigorous duty within a mine, especially in coal mines. The various components can be made to withstand repeated dragging around the mine and mistreatment by the mine workers. All of the embodiments can be advantageously constructed to require no electric power, no air supply, or no water supply.

It is recommended that the refuges deployed in the mine be periodically (e.g., weekly, monthly) inspected for visual signs of damage, to ensure the tamperproof seal is unruptured, and to verify the amount of oxygen available in the oxygen supply system is sufficient. It is also recommended that a deployed refuge be factory recommissioned after a period of about 5 years. During the recommissioning, the oxygen and purge cylinders should be removed and hydrostatically tested, the provisions replaced, and any damage to the refuge repaired. It is contemplated that the recommissioning can be performed after different time periods and can be done on an as needed basis should the refuge warrant it.

When introducing elements of various aspects of the present invention or embodiments thereof, the articles "a", "an", "the" and "said" are intended to mean that there are one or more of the elements. The terms "comprising", "including" and "having" are intended to be inclusive and mean that there may be additional elements other than the listed elements. Moreover, the use of "top" and "bottom", "front" and "rear", "above" and "below" and variations of these and other terms of orientation is made for convenience, but does not require any particular orientation of the components.

As various changes could be made in the above constructions, methods and products without departing from the scope of the invention, it is intended that all matter contained in the above description or shown in the accompanying drawings shall be interpreted as illustrative and not in a limiting sense. Further, all dimensional information set forth herein is exemplary and is not intended to limit the scope of the invention.

What is claimed is:

1. A mine refuge for use in a mine comprising:

a chamber sized and shaped for occupancy by at least one miner;

an oxygen supply adapted to be installed in the chamber for supplying oxygen to the chamber; and a carbon dioxide reduction system adapted to be installed in the chamber for reducing carbon dioxide in the chamber, the carbon dioxide reduction system being operable in the mine without an electrical power source, said carbon dioxide reduction system comprising a carbon dioxide absorbent material, a blower, and a source of pressurized gas for operating the blower to move air in the chamber to said carbon dioxide absorbent material for absorption of carbon dioxide in the air.

2. The mine refuge as set forth in claim 1 wherein said carbon dioxide absorbent material further comprises soda lime.

3. The mine refuge as set forth in claim 1 wherein the source of pressurized gas comprises a cylinder of pressurized gas in the chamber.

4. The mine refuge as set forth in claim 1 further comprising a purge system for purging gas from the chamber.

5. The mine refuge as set forth in claim 4 wherein the purge system includes a cylinder of compressed breathable air in the mine refuge sufficient to maintain a positive pressure in the chamber for inhibiting entry of contaminated mine air into the chamber.

6. The mine refuge as set forth in claim 5 wherein the flow rate of air from the cylinder of compressed breathable air is adjustable based on the number of occupants in the chamber.

7. The mine refuge as set forth in claim 6 further comprising a pressure relief valve adapted to automatically open when pressure within the refuge meets or exceeds a predetermined limit.

8. The mine refuge as set forth in claim 1 wherein the chamber includes a main compartment and an airlock having a vent for venting gas from the airlock.

9. The mine refuge as set forth in claim 1 further comprising an entryway and tamperproof seal on the entryway to inhibit tampering with the chamber when not in use.

10. The mine refuge as set forth in claim 1 wherein the chamber comprises at least one wall member adapted to be installed in the mine generally between a floor of the mine and a roof of the mine to thereby at least in part define a substantially sealed chamber.

11. The mine refuge as set forth in claim 10 further comprising a base supporting the oxygen supply and carbon dioxide reduction system.

12. The mine refuge as set forth in claim 1 comprising a plurality of wall members, a base and a roof, the wall members, roof, and base cooperatively defining the chamber.

13. The mine refuge as set forth in claim 12 further comprising a protective cage extending over the walls and roof of the chamber for protecting the refuge from damage.

14. The mine refuge as set forth in claim 13 wherein the protective cage is spaced from the walls and roof.

15. The mine refuge as set forth in claim 14 wherein the protective cage includes plates for protecting the refuge from damage caused by falling debris.

16. The mine refuge as set forth in claim 12 wherein the roof is arch-shaped for protecting the refuge from damage caused by falling debris.

17. The mine refuge as set forth in claim 10 further comprising an oxygen supply support system for securely supporting the supply to thereby inhibit movement and damage.

18. The mine refuge as set forth in claim 11 wherein the base is free of axles and wheels.

19. The mine refuge as set forth in claim 18 wherein the base is adapted to facilitate dragging the refuge from one location to another location.

20. The mine refuge as set forth in claim 12 wherein the wall members are interengageable elongate panels.

21. The mine refuge as set forth in claim 1 further comprising at least one window, the window being removable in case of an emergency.

22. The mine refuge as set forth of claim 1 wherein the chamber includes a receptacle adapted to receive human waste, and a drain associated with the receptacle for draining the receptacle to a location outside of the chamber.

23. The mine refuge as set forth in claim 1 further comprising a flow meter connected to the oxygen supply, the flow meter being adjustable by occupants for adjusting the flowrate at which the oxygen is dispensed from the oxygen supply.

24. The mine refuge as set forth in claim 23 wherein the flowrate of oxygen can be selectively adjusted based on the number of occupants in the chamber so that a sufficient amount of breathable air is supplied to each occupant while maintaining the level of oxygen in the refuge at a level suitable for occupation.

25. The mine refuge as set forth in claim 23 wherein the oxygen supply includes multiple oxygen tanks, a manifold connecting the tanks, a flow meter for displaying flow therefrom, a display of the remaining oxygen, and a regulator.

26. The mine refuge as set forth in claim 7 wherein the flow rate of air from the cylinder of compressed breathable air is adjustable to a constant rate that is greater than the volume of gas being consumed by both the miners and the carbon dioxide reduction system.

27. The mine refuge as set forth in claim 1 wherein said carbon dioxide reduction system further comprises a selector for controlling the flow of said pressurized gas to said blower.

28. The mine refuge as set forth in claim 1 wherein the blower comprises a turbine rotated by said pressurized gas, and a fan rotated by the turbine.

29. The mine refuge as set forth in claim 1 wherein the blower comprises a piston movable in a cylinder by said pressurized gas.

30. The mine refuge as set forth in claim 1 wherein the source of pressurized gas comprises a cylinder of oxygen in the chamber.

31. The mine refuge as set forth in claim 25 wherein the flow meter, display, and regulator are visible from outside the chamber.

32. A mine refuge for use in a mine comprising:

a chamber sized and shaped for occupancy by at least one miner;

an oxygen supply adapted to be installed in the chamber for supplying oxygen to the chamber; and a carbon dioxide reduction system adapted to be installed in the chamber for reducing carbon dioxide in the chamber, the carbon dioxide reduction system being operable in the mine without an electrical power source; and a plurality of wall members, a base and a roof, the wall members, roof, and base cooperatively defining the chamber, wherein the wall members are hingedly connected to the base.

33. The mine refuge as set forth in claim 32 wherein the roof is hingedly connected to at least one of the wall members.

34. A mine refuge for use in a mine comprising:

a chamber sized and shaped for occupancy by at least one miner;

an oxygen supply adapted to be installed in the chamber for supplying oxygen to the chamber; and a carbon dioxide reduction system adapted to be installed in the chamber for reducing carbon dioxide in the chamber, the carbon dioxide reduction system being operable in the mine without an electrical power source;

a plurality of wall members, a base and a roof, the wall members, roof, and base cooperatively defining the chamber; and at least one crush zone, each crush zone including a telescoping member adapted for movement upon impact so that the impact is directed away from the oxygen supply.

35. A mine refuge for use in a mine comprising:

a chamber sized and shaped for occupancy by at least one miner;

an oxygen supply adapted to be installed in the chamber for supplying oxygen to the chamber; and a carbon dioxide reduction system adapted to be installed in the chamber for reducing carbon dioxide in the chamber, the carbon dioxide reduction system being operable in the mine without an electrical power source, wherein carbon dioxide is forced through the carbon dioxide reduction system by oxygen from the oxygen supply.

* * * * *